US010434789B2

(12) United States Patent
Horade

(10) Patent No.: US 10,434,789 B2
(45) Date of Patent: Oct. 8, 2019

(54) LIQUID DISCHARGE APPARATUS

(71) Applicant: BROTHER KOGYO KABUSHIKI KAISHA, Nagoya-shi, Aichi-ken (JP)

(72) Inventor: Kenta Horade, Toukai (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/925,898

(22) Filed: Mar. 20, 2018

(65) Prior Publication Data

US 2018/0272732 A1 Sep. 27, 2018

(30) Foreign Application Priority Data

Mar. 22, 2017 (JP) ..... 2017-056519

(51) Int. Cl.
*B41J 2/175* (2006.01)
*B41J 2/21* (2006.01)

(52) U.S. Cl.
CPC ..... *B41J 2/17566* (2013.01); *B41J 2/1752* (2013.01); *B41J 2/17503* (2013.01); *B41J 2/17543* (2013.01); *B41J 2/2103* (2013.01); *B41J 2002/17589* (2013.01)

(58) Field of Classification Search
CPC ..... B41J 2/1752; B41J 2/17543
See application file for complete search history.

(56) References Cited

U.S. PATENT DOCUMENTS

2003/0025743 A1 2/2003 Maeda
2007/0008351 A1 1/2007 Teshigawara et al.
2011/0001772 A1* 1/2011 Sakurai ..... B41J 2/175 347/7
2014/0104349 A1* 4/2014 Kimura ..... B41J 2/17509 347/85
2016/0214392 A1 7/2016 Honoki et al.
2016/0279962 A1* 9/2016 Ishida ..... B41J 2/17566
2016/0279963 A1 9/2016 Koganehira et al.

FOREIGN PATENT DOCUMENTS

EP 1 754 609 A2 2/2007
JP 2002-264356 A 9/2002
JP 2004-209669 A 7/2004
JP 5164570 B2 3/2013

OTHER PUBLICATIONS

Extended European Search Report dated Aug. 14, 2018 from related EP 18162889.2.

* cited by examiner

*Primary Examiner* — Kristal Feggins
*Assistant Examiner* — Kendrick X Liu
(74) *Attorney, Agent, or Firm* — Scully, Scott, Murphy & Presser, P.C.

(57) ABSTRACT

A liquid discharge apparatus includes a controller configured to: control a head to discharge liquid in accordance with a discharge instruction; update a first count value to a value corresponding to an amount of liquid instructed to be discharged by the discharge instruction after a cartridge is mounted to a cartridge holder in a direction of approximating to a threshold value A; receive a first signal from a sensor; receive a second signal from the sensor; and when the first count value upon the receiving of the second signal reaches a threshold value α, operate a notification device in response to an updated first count value updated after the receiving of the second signal reaching the threshold value A. The threshold value A is more distant from an initial value of the first count value than the threshold value α.

13 Claims, 9 Drawing Sheets

| | SETTING VALUE | DISCHARGEABLE AMOUNT OF INK |
|---|---|---|
| A | 80 | 80 |
| B | 90 | 90 |
| C | 45 | 90 ~ 100 |
| X | 25 | 70 ~ 80 |
| Y | 35 | 80 ~ 90 |

LIQUID DISCHARGE APPARATUS

CROSS-REFERENCE TO RELATED APPLICATION

This application claims priority from Japanese Patent Application No. 2017-056519 filed on Mar. 22, 2017, the entire subject-matter of which is incorporated herein by reference.

TECHNICAL FIELD

The disclosure relates to a liquid discharge apparatus configured to discharge liquid retained in a cartridge.

BACKGROUND

There has been proposed an inkjet print apparatus configured to record an image to a sheet by discharging ink retained in a cartridge. The cartridge includes a detection object, which is an object to be detected that is to be changed when a remaining amount of ink in the cartridge becomes a predetermined amount. The related-art inkjet print apparatus is configured to start a count of a discharged amount of ink, in response to a change of the detection object in the cartridge being detected by an optical unit. The related-art inkjet print apparatus determines that the cartridge is out of ink, when the count value reaches a predetermined value.

SUMMARY

One illustrative aspect of the disclosure provides a liquid discharge apparatus including a controller configured to: control a head to discharge liquid in accordance with a discharge instruction; update a first count value to a value corresponding to an amount of liquid instructed to be discharged by the discharge instruction after a cartridge is mounted to a cartridge holder in a direction of approximating to a threshold value A; receive a first signal from a sensor; receive a second signal from the sensor; and when the first count value upon the receiving of the second signal reaches a threshold value α, operate a notification device in response to an updated first count value updated after the receiving of the second signal reaching the threshold value A. The threshold value A is more distant from an initial value of the first count value than the threshold value α.

DETAILED DESCRIPTION

In the related-art inkjet print apparatus, when detecting the remaining amount of ink by the optical unit, errors may be caused due to a mounting error of the detection object for each cartridge, aging deterioration of the optical unit, and the like. For this reason, the remaining amount of ink, which actually remains in the cartridge upon the detection of the predetermined amount by the optical unit, is not uniform for each cartridge.

More specifically, when an actual remaining amount of ink upon the detection of the predetermined amount by the optical unit is larger than the predetermined amount, the count of the discharged amount of ink is started earlier than designed timing. For this reason, the ink that remains in the cartridge without being discharged increases at a point of time at which a count value reaches a predetermined value. On the other hand, when the actual remaining amount of ink upon the detection of the predetermined amount by the optical unit is smaller than the predetermined amount, the count of the discharged amount of ink is started later than the designed timing. For this reason, there is a possibility that the air will be mixed in the ink to be discharged before the count value reaches a predetermined value and an image recording quality will be thus lowered.

Therefore, the disclosure provides a liquid discharge apparatus capable of notifying a remaining amount of liquid retained in a cartridge at appropriate timing without being influenced by a detection error of a remaining amount sensor.

Hereinafter, an illustrative embodiment of the disclosure will be described with reference to the drawings. In the meantime, the illustrative embodiment to be described later is just an implemented example of the disclosure, and can be appropriately changed without changing the gist of the disclosure.

(Outline of Printer 10)

Figure 1:
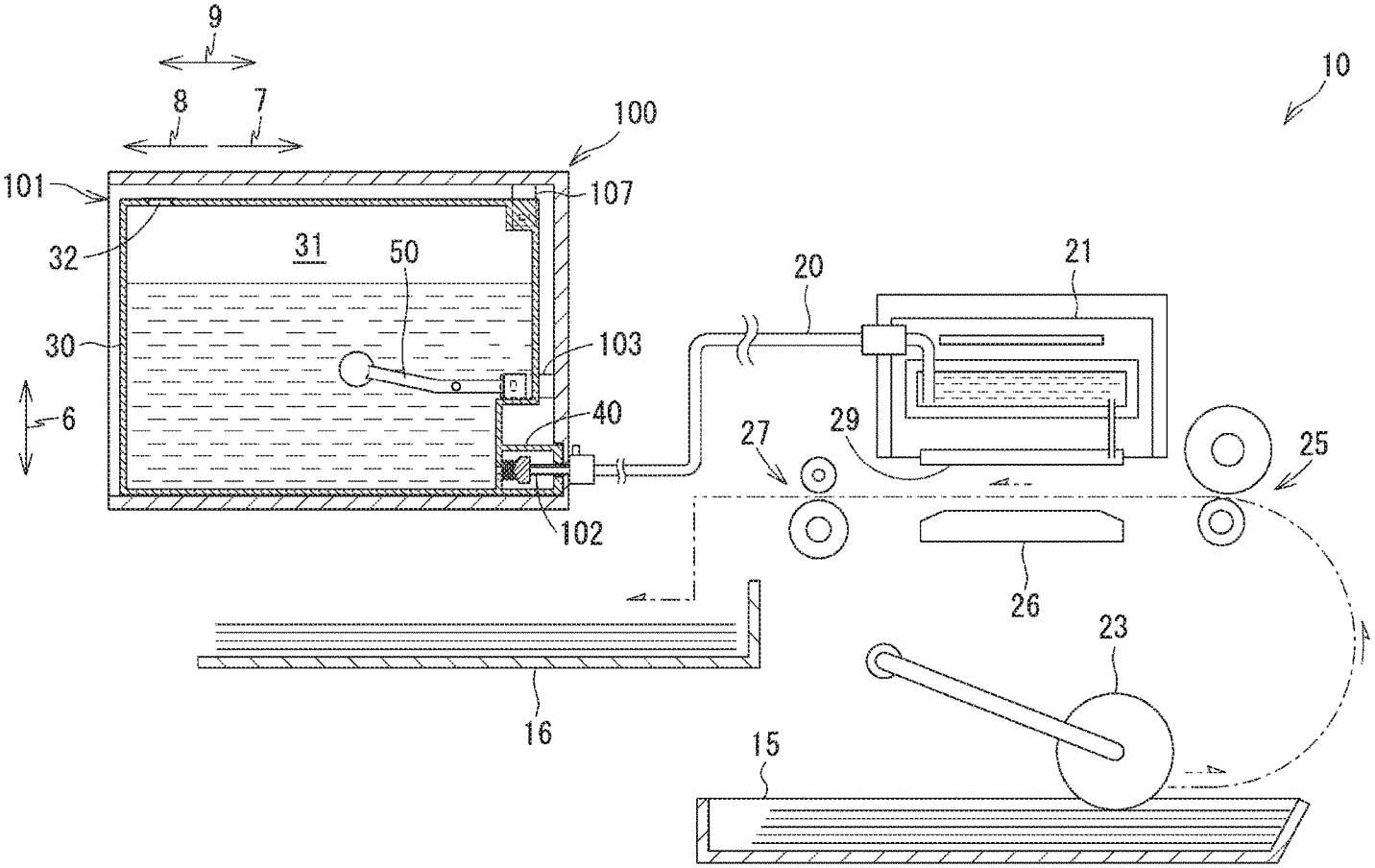
FIG. 1 is a pictorial sectional view depicting an internal structure of a printer 10 having a cartridge holder 100 in accordance with an illustrative embodiment.

A printer 10 of the illustrative embodiment is an example of the liquid discharge apparatus configured to record an image on a sheet in an inkjet recording manner. As shown in FIG. 1, the printer 10 mainly includes a feeding tray 15, a feeder roller 23, a conveyance roller unit 25, a head 21 having a plurality of nozzles 29, a platen 26 configured to face the head 21, a discharge roller unit 27, a discharge tray 16, a cartridge holder 100 to which a cartridge 30 is detachably mounted, and a tube 20 configured to communicate the head 21 and the cartridge 30 mounted to the cartridge holder 100.

The printer 10 is configured to drive the feeder roller 23 and the conveyance roller unit 25, thereby conveying a sheet supported to the feeding tray 15 to a position of the platen 26. Then, the printer 10 is configured to discharge ink, which is supplied from the cartridge 30 mounted to the cartridge holder 100 through the tube 20, from the nozzles 29 of the head 21. Thereby, the ink is jetted to the sheet supported to the platen, so that an image is recorded on the sheet. Then, the printer 10 is configured to drive the discharge roller unit 27, thereby discharging the sheet having the image recorded thereon to the discharge tray 16.

(Cartridge Holder 100)

The cartridge holder 100 has a box shape having an internal space in which the cartridge 30 is to be accommodated. The internal space of the cartridge holder 100 is defined by a top wall, a bottom wall, an inner wall and a pair of sidewalls. In the meantime, an opening 101 through which the internal space is exposed to an outside is formed at a position facing the inner wall of the cartridge holder 100. The cartridge 30 is inserted into the internal space of the cartridge holder 100 through the opening 101, and is demounted from the internal space of the cartridge holder 100 through the opening 101.

In the below, a direction in which the cartridge 30 is inserted into the cartridge holder 100 is referred to as "insertion direction 7", and a direction in which the cartridge 30 is demounted from the cartridge holder 100 is referred to as "demounting direction 8". The insertion direction 7 and the demounting direction 8 are directions following a horizontal direction, and are also opposite to each other. Also, the insertion direction 7 and the demounting direction 8 are collectively referred to as "insertion/demounting direction 9", and a horizontal direction perpendicular to the insertion/demounting direction 9 is referred to as "width direction".

Figure 2:
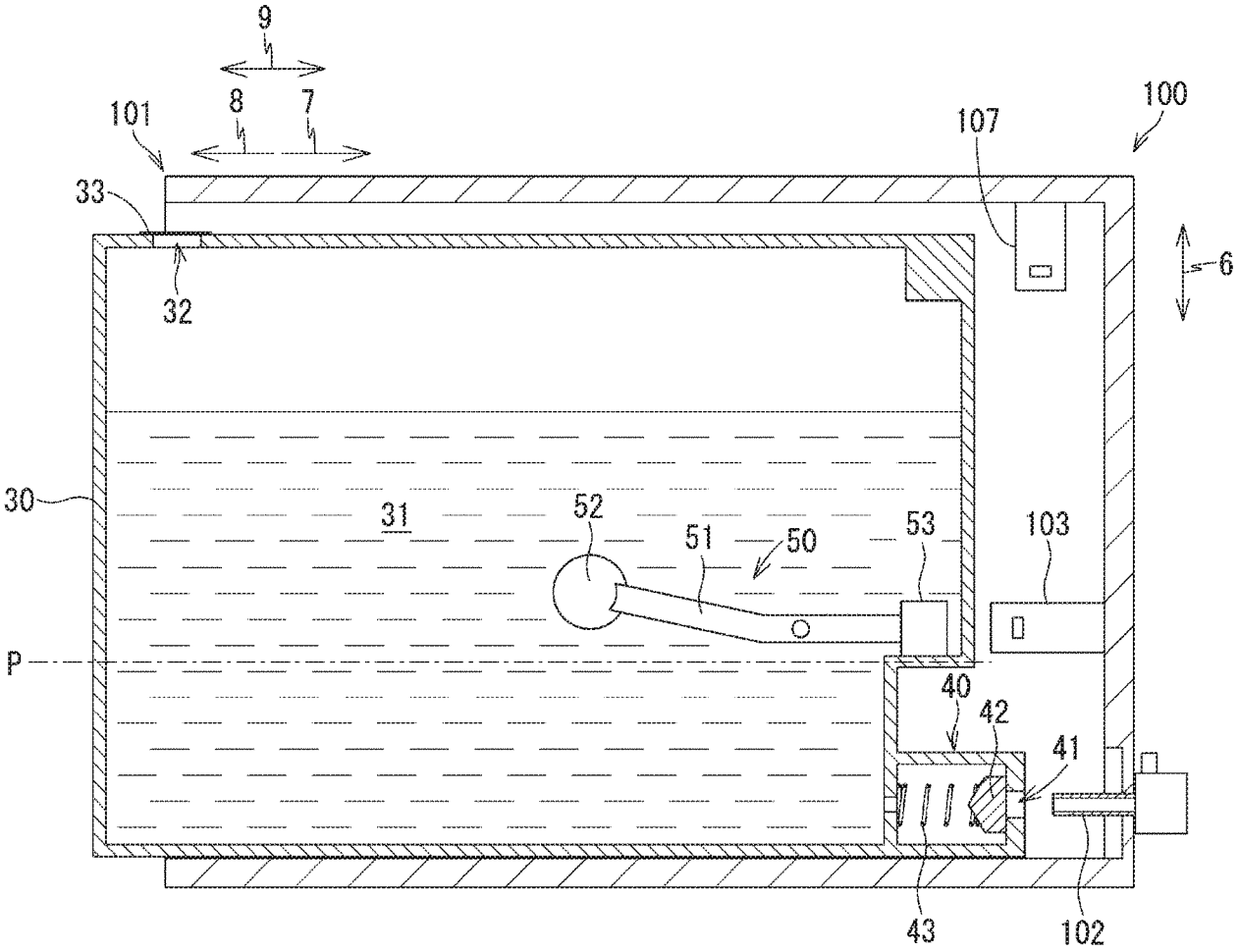
FIG. 2 is a longitudinal sectional view depicting a state before a cartridge 30 is mounted to the cartridge holder 100.

As shown in FIG. 2, the cartridge holder 100 includes a needle 102, a remaining amount sensor 103, and a mounting sensor 107. In the meantime, the cartridge holder 100 is mounted with the four cartridges 20 in which black ink, cyan ink, magenta ink, and yellow ink are respectively retained. The needle 102, the remaining amount sensor 103 and the mounting sensor 107 are respectively provided by four, in correspondence to the four cartridges 30. The number of the cartridges 30 that can be mounted to the cartridge holder 100 is not limited to four, and may be one or five or more.

(Needle 102)

The needle 102 protrudes from the inner wall of the cartridge holder 100 in the demounting direction 8. The needle 102 is a pipe having a flow path formed therein. Also, the needle 102 is formed of resin. The needle 102 has an end portion, which is exposed to the internal space of the cartridge holder 100 and is opened, and an opposite end portion connected to the tube 20. The needle 102 is configured to communicate the tube 20 and a liquid chamber 31 (which will be described later) of the cartridge 30 mounted to the cartridge holder 100.

(Remaining Amount Sensor 103)

The remaining amount sensor 103 is disposed at a position higher than the needle 102 in the vertical direction 6. The remaining amount sensor 103 includes a light emitting unit and a light receiving unit disposed to face each other in the width direction. The cartridge 30 mounted to the cartridge holder 100 is disposed between the light emitting unit and the light receiving unit of the remaining amount sensor 103. In other words, the light emitting unit and the light receiving unit are disposed to face each other with the cartridge 30 mounted to the cartridge holder 100 being interposed therebetween.

The remaining amount sensor 103 is configured to output signals (referred to as "remaining amount signal", in the drawings) having different signal levels, in response to whether light emitted from the light emitting unit is received at the light receiving unit. The remaining amount sensor 103 outputs a low-level signal to a controller 130 (refer to FIG. 5), when a received light intensity of the light received at the light receiving unit is lower than a threshold value intensity, for example. On the other hand, when the received light intensity of the light received at the light receiving unit is equal to or greater than the threshold value intensity, the remaining amount sensor 103 outputs a high-level signal having a signal level higher than the low-level signal to the controller 130.

(Mounting Sensor 107)

Figure 3:
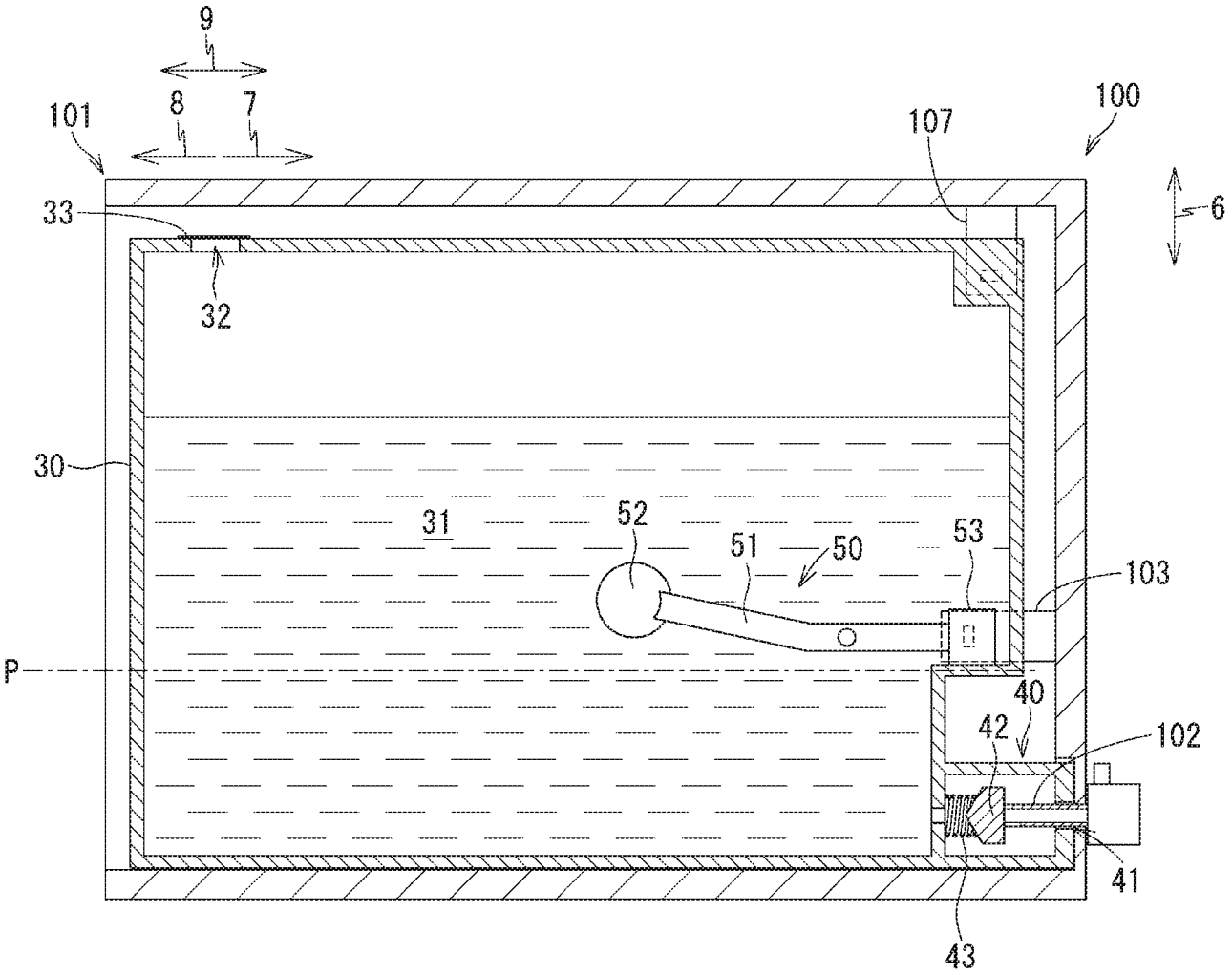
FIG. 3 is a longitudinal sectional view depicting a state where the cartridge 30 is mounted to the cartridge holder 100 and a detection object 53 is disposed at a first position.
Figure 4:
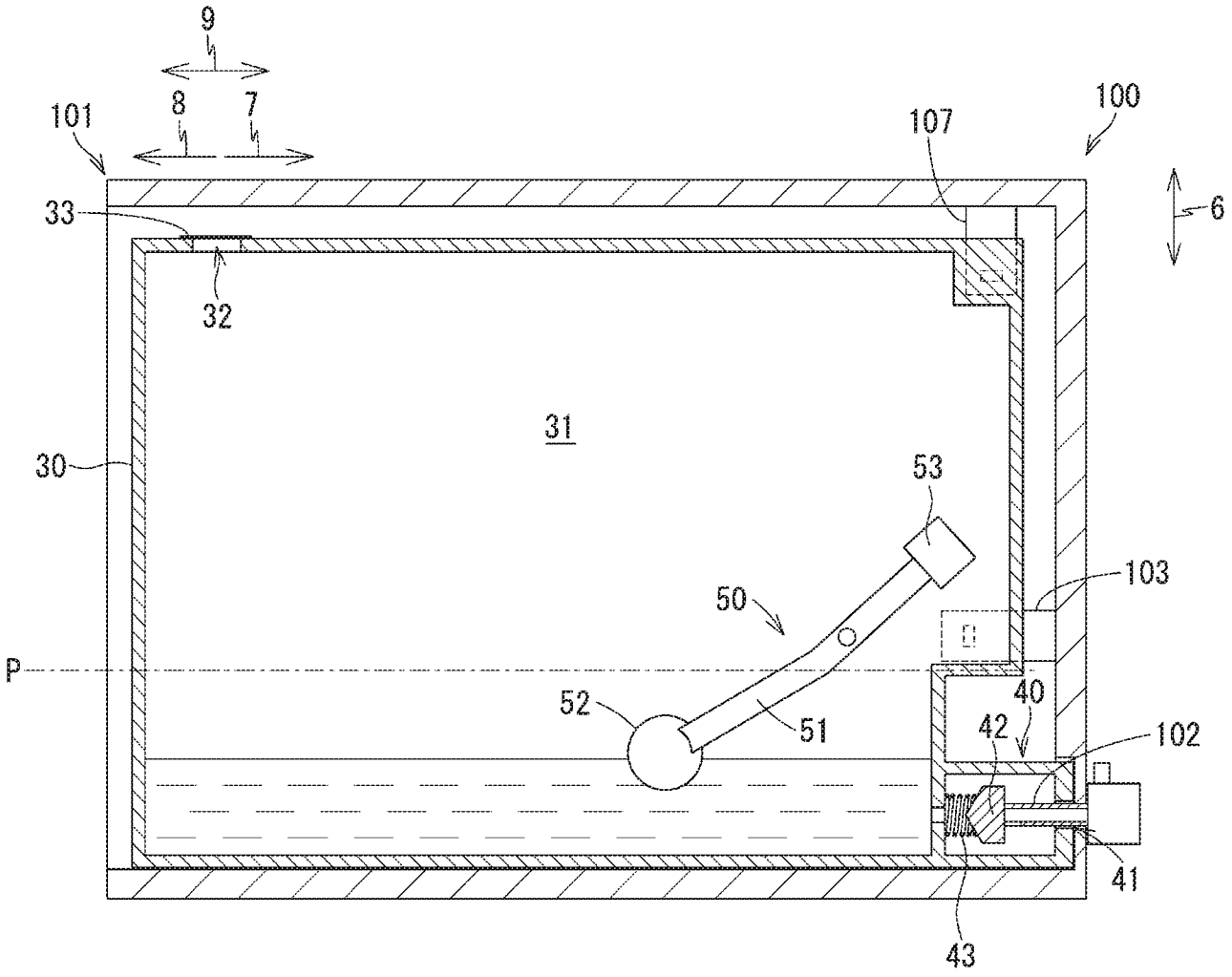
FIG. 4 is a longitudinal sectional view depicting a state where the cartridge 30 is mounted to the cartridge holder 100 and the detection object 53 is disposed at a second position.

The mounting sensor 107 is configured to output signals (referred to as "mounting signal", in the drawings) having different signal levels, in response to whether the cartridge 30 is mounted to the cartridge holder 100. More specifically, as shown in FIGS. 3 and 4, when the cartridge 30 is mounted to the cartridge holder 100, the mounting sensor 107 outputs a high-level signal to the controller 130. On the other hand, as shown in FIG. 2, when the cartridge 30 is not mounted to the cartridge holder 100, the mounting sensor 107 outputs a low-level signal to the controller 130.

(Cartridge 30)

As shown in FIG. 2, the cartridge 30 is a receptacle having a liquid chamber 31 that can retain therein ink, which is an example of the liquid. The liquid chamber 31 is defined by walls of resin, for example. The cartridge 30 has a flat shape of which sizes in the vertical direction 6 and the insertion/demounting direction 9 are greater than a size in the width direction. In the meantime, outer shapes of the cartridges 30 in which the inks of different colors are respectively retained may be the same or different.

As shown in FIGS. 3 and 4, at a state where the cartridge 30 is mounted to the cartridge holder 100, the light emitted from the light emitting unit of the remaining amount sensor 103 penetrates the wall of the cartridge 30 facing the remaining amount sensor 103. Also, at the state where the cartridge 30 is mounted to the cartridge holder 100, the wall of the cartridge 30 facing the mounting sensor 107 shields the light emitted from the light emitting unit. Also, the cartridge 30 has an atmosphere communication port 32, a supply pipe 40, and a sensor arm 50.

The atmosphere communication port 32 is configured to communicate the liquid chamber 31 and the outside of the cartridge 30 each other. The atmosphere communication port 32 is formed at a position higher than the supply pipe 40. The atmosphere communication port 32 is sealed by a semipermeable membrane 33 configured to block passing of the ink and to permit passing of a gas. Alternatively, the cartridge 30 may include a valve that opens the atmosphere communication port 32 when the cartridge 30 is mounted to the cartridge holder 100. The valve may close the atmosphere communication port 32 when the cartridge 30 is demounted from the cartridge holder 100.

The supply pipe 40 has a substantially cylindrical outer shape, and protrudes from a lower part of the cartridge 30 in the insertion direction 7. A protruding end of the supply pipe 40 is formed with an opening 41. Also, an internal space of the supply pipe 40 is formed to communicate with the liquid chamber 31. That is, the ink retained in the liquid chamber 31 is enabled to outflow to the outside of the cartridge 30 through the internal space of the supply pipe 40 and the opening 41. Also, a valve 42 and a coil spring 43 are accommodated in the internal space of the supply pipe 40.

The valve 42 is configured to move, in the internal space of the supply pipe 40, between a closed position (refer to FIG. 2) at which the opening 41 is to be closed and an opened position (refer to FIGS. 3 and 4) at which the opening 41 is to be opened, along the insertion/demounting direction 9. The coil spring 43 is configured to urge the valve 42 toward the closed position in the insertion direction 7. That is, the ink in the liquid chamber 31 outflows to the outside of the cartridge 30 through the opening 41 when the valve 42 is located at the opened position. On the other hand, when the valve 42 is located at the closed position, the ink in the liquid chamber 31 does not outflow to the outside of the cartridge 30.

While the cartridge 30 is being mounted to the cartridge holder 100, the needle 102 is introduced into the internal space of the supply pipe 40 through the opening 41. Then, the needle 102 introduced into the internal space of the supply pipe 40 moves the valve 42 from the closed position to the opened position against the urging force of the coil spring 43. Thereby, the liquid chamber 31 of the cartridge 30 and the head 21 communicate with each other through the supply pipe 40, the needle 102, and the tube 20.

(Sensor Arm 50)

The sensor arm 50 is disposed in the liquid chamber 31. The sensor arm 50 has an arm 51, a float 52, and a detection object 53. The arm 51 is supported to be rotatable on a plane including the vertical direction 6 and the insertion/demounting direction 9, in the liquid chamber 31. The float 52 is formed of a material of which a specific weight is smaller than the ink retained in the liquid chamber 31. The float 52 is formed at one end of the arm 51. The detection object 53 is formed of a material or color capable of shielding the light that is to be emitted from the light emitting unit of the remaining amount sensor 103. The detection object 53 is formed at the other end of the arm 51.

The sensor arm 50 is configured to rotate with a posture at which the buoyance and the gravity are balanced, in the liquid chamber 31. That is, the sensor arm 50 is configured to rotate, in association with a change in an amount of the ink retained in the liquid chamber 31. More specifically, as shown in FIGS. 2 and 3, when a liquid level of the ink in the liquid chamber 31 is equal to or higher than a detection position P, the sensor arm 50 assumes a posture at which the detection object 53 is located at a first position. On the other hand, as shown in FIG. 4, when a liquid level of the ink in the liquid chamber 31 is lower than the detection position P, the sensor arm 50 assumes a posture at which the detection object 53 is located at a second position different from the first position.

The first position is a position that overlaps with a light path between the light emitting unit and the light receiving unit of the remaining amount sensor 103 when the cartridge 30 is mounted to the cartridge holder 100. The second position is a position that deviates from the light path between the light emitting unit and the light receiving unit of the remaining amount sensor 103 when the cartridge 30 is mounted to the cartridge holder 100. The detection position P is a position of a liquid level when a predetermined amount (for example, 50) of ink of an amount of ink (for example, 100) retained in the liquid chamber 31 of the brand-new cartridge 30 is consumed.

That is, the remaining amount sensor 103 outputs a low-level signal to the controller 130 when the detection object 53 of the cartridge 30 mounted to the cartridge holder 100 is located at the first position. In other words, the remaining amount sensor 103 outputs a low-level signal to the controller 130 when the liquid level in the cartridge 30 mounted to the cartridge holder 100 is equal to or higher than the detection position P. The low-level signal is an example of the first signal. On the other hand, when the detection object 53 of the cartridge 30 mounted to the cartridge holder 100 is located at the second position, the remaining amount sensor 103 outputs a high-level signal to the controller 130. In other words, the remaining amount sensor 103 outputs a high-level signal when the liquid level in the cartridge 30 mounted to the cartridge holder 100 is lower than the detection position P. The high-level signal is an example of the second signal.

(Controller 130)

Figure 5:
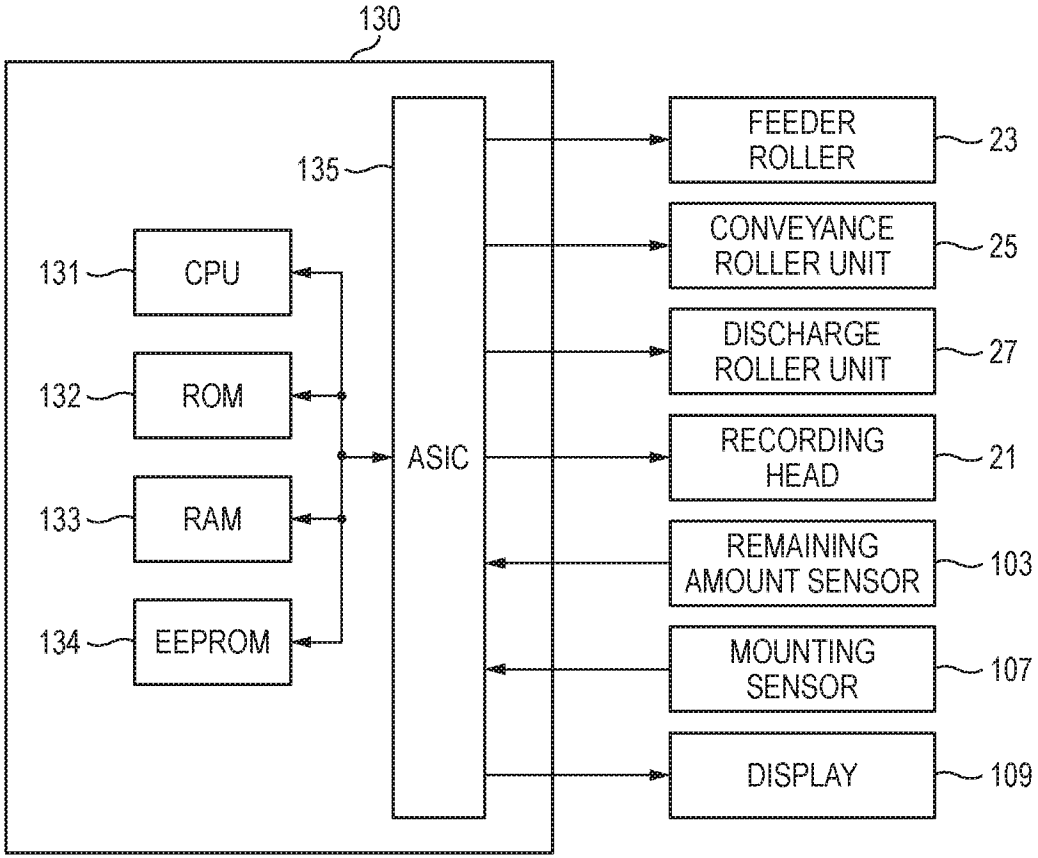
FIG. 5 is a block diagram of the printer 10.

The printer 10 further includes the controller 130. As shown in FIG. 5, the controller 130 includes a CPU 131, a ROM 132, a RAM 133, an EEPROM 134, and an ASIC 135. In the ROM 132, a program and the like with which the CPU 131 controls diverse operations are stored. The RAM 133 is used as a storage area for temporarily storing therein data, signals and the like, which are to be used when the CPU 131 executes the program, or as a work area of data processing. In the EEPROM 134, a setting, a flag and the like, which are to be kept even after a power supply is off, are stored.

The ASIC 135 is connected with the feeder roller 23, the conveyance roller unit 25, the discharge roller unit 27, and the head 21. The controller 130 is configured to drive a motor (not shown) through the ASIC 135, thereby rotating the feeder roller 23, the conveyance roller unit 25, and the discharge roller unit 27. Also, the controller 130 is configured to output a driving signal to a driving element (not shown) through the ASIC 135, thereby discharging the ink from the nozzles 29 of the head 21. The ASIC 135 can output a variety of driving signals, in correspondence to an amount of ink to be discharged from the nozzles 29.

Also, the ASIC 135 is connected with the remaining amount sensor 103, the mounting sensor 107, and a display 109. That is, the controller 130 is connected with the remaining amount sensor 103, the mounting sensor 107, and the display 109. Also, the controller 130 is configured to display information on the display 109 through the ASIC 135. The display 109 is an example of the notification device. However, the specific example of the notification device is not limited to the display 109, and may be a speaker, an LED lamp or a combination thereof.

In the EEPROM 134, a variety of information shown in FIG. 9 is stored in association with each of the plurality of cartridges 30 to be mounted to the cartridge holder 100, i.e., in association with colors of the inks retained in the respective cartridges 30. The variety of information indicates threshold values α, β, an ALL count value, a sensor count value, an ink-low flag, an empty flag, threshold values A, B, C, X, Y, and CTG type information. The ALL count value is an example of the first count value, and the sensor count value is an example of the second count value.

The threshold value α is a value (for example, 45) obtained by subtracting a detection error of the remaining amount sensor 103 from a design value (for example, 50) preset as an amount of ink that should be retained in the cartridge 30 at a point of time at which an output signal of the remaining amount sensor 103 has changed from the low-level signal to the high-level signal, for example. The threshold value β is a value (for example, 55) obtained by adding the detection error of the remaining amount sensor 103 to the design value preset as an amount of ink that should be retained in the cartridge 30 at a point of time at which an output signal of the remaining amount sensor 103 has changed from the low-level signal to the high-level signal, for example. That is, the threshold value β is a value greater than the threshold value α.

The signal to be output from the remaining amount sensor 103 is designed to change from the low-level signal to the high-level signal at timing at which the liquid level of the ink in the liquid chamber 31 becomes lower than the detection position P. However, in actual using environments, there are a variety of causes such as production tolerance of the cartridge 30, a mounting error of the sensor arm 50, aging deterioration of the remaining amount sensor 103, and the like. Due to the causes, an actual position of the liquid level may be different from the detection position P at a point of time at which the output of the remaining amount sensor 103 has changed from the low-level signal to the high-level signal.

That is, while the liquid level of the ink is higher than the detection position P, the output of the remaining amount sensor 103 may change from the low-level signal to the high-level signal. Alternatively, after the liquid level of the ink becomes lower than the detection position P, the output of the remaining amount sensor 103 may change from the low-level signal to the high-level signal. In the below, the change in output of the remaining amount sensor 103 from the low-level signal to the high-level signal is simply referred to as "the output of the remaining amount sensor 103 changes".

Therefore, the threshold values α, β are preset so as to cover a range (for example, a design value±5) of the detection error of the remaining amount sensor 103 obtained by a test or simulation. In the meantime, regarding the ranges indicated by the threshold values α, β, followings may be considered, in addition to the detection error of the remaining amount sensor 103. For example, a difference (so-called, discharge mismatch) between an amount of ink indicated by a driving signal and an amount of ink to be actually discharged from the nozzles 29 may be considered. Also, mismatch (so-called, dispensing mismatch) of an amount of ink dispensed to the brand-new cartridge 30 may be considered.

The ALL count value is an integration value of a discharged amount of ink after the cartridge 30 is mounted to the cartridge holder 100, for example. The ALL count value is updated to a value equivalent to an amount of ink, which is instructed to be discharge through the head 21 after the cartridge 30 is mounted to the cartridge holder 100, in a direction of approximating to the threshold value A, B. The sensor count value is an integration value of the discharged amount of ink after the output of the remaining amount sensor 103 changes, for example. The sensor count value is updated to a value equivalent to an amount of ink, which is instructed to be discharge through the head 21, in a direction of approximating to the threshold value C, X, Y after the output of the remaining amount sensor 103 changes. In the meantime, the ALL count value and the sensor count value of the illustrative embodiment are values that are to be counted up from "0", which is an initial value. That is, the ALL count value and the sensor count value indicate the discharged amount of ink.

The ALL count value and the sensor count value may be values that are to be counted down from the maximum retention amount "100" of the cartridge 30, which is an initial value. In this case, the ALL count value and the sensor count value may indicate the remaining amount of ink. Also, in this case, the threshold values α, β, A, B, C, X, Y may be values obtained by subtracting the setting values of FIG. 9 from the maximum retention amount "100" of the cartridge 30, for example. Also, the description "update in the direction of approximating to the threshold value" indicates a relation between an initial value of the count value and the threshold value. That is, the ALL count value that is to be counted up is continuously counted up even after it reaches the threshold value A, B. Also, the ALL count value that is to be counted down is continuously counted down even after it reaches the threshold value A, B. This also applies to the sensor count value.

The ink-low flag is information indicating whether the corresponding cartridge 30 is in an ink-low state. For the ink-low flag, a value "ON" corresponding to the ink-low state or a value "OFF" corresponding to a state that is not the ink-low state is set. The empty flag is information indicating whether the corresponding cartridge 30 is in an empty state. For the empty flag, a value "ON" corresponding to the empty state or a value "OFF" corresponding to a state that is not the empty state is set. The ink-low flag and the empty flag have an initial value "OFF".

The ink-low state indicates a state where the ink still remains in the corresponding cartridge 30 but the cartridge 30 is to be replaced soon. That is, in the ink-low state, the ink may be continuously discharge through the head 21. The empty state is a state where the ink little remains in the corresponding cartridge 30. That is, the ink retained in the cartridge 30 of the empty state is less than the ink in the ink-low state. If the ink is continuously discharge through the head 21 after the empty state, the nozzles 29 are not filled with the ink and the air may be mixed (so-called, air-in). That is, the empty state is a state where the discharge of ink by the head 21 should be prohibited.

The threshold value A is a value (for example, 80) smaller than the maximum retention amount (for example, 100) that can be retained in the corresponding cartridge 30 and greater than the threshold value α (for example, 45), for example. The threshold value A is used so as for the controller 130 to determine whether the corresponding cartridge 30 is in the ink-low state by comparing the same with the ALL count value, for example. The threshold value B is a value (for example, 90) smaller than the maximum retention amount that can be retained in the corresponding cartridge 30 and greater than the threshold value A, for example. The threshold value B is used so as for the controller 130 to determine whether the corresponding cartridge 30 is in the empty state by comparing the same with the ALL count value, for example.

The threshold value C is a value (for example, 45) that becomes equal to or greater than the threshold value B (for example, 90) when the threshold value α (for example, 45) is added thereto and becomes equal to or smaller than the maximum retention amount (for example, 100) of the cartridge 30 even when the threshold value β (for example, 55) is added thereto. For example, a difference between an initial value "0" of the sensor count value and the threshold value C is smaller than a difference between the ALL count value and the threshold value A at a point of time at which the output of the remaining amount sensor 103 has changed. The threshold value C is used so as for the controller 130 to determine whether the corresponding cartridge 30 is in the empty state by comparing the same with the sensor count value, for example. The threshold value C is determined so that, when the corresponding ALL count value is appropriately updated, the ALL count value reaches the threshold value B before the sensor count value reaches the threshold value C. That is, the threshold value C is used as a fail-safe when the ALL count value is initialized by the unintentional overwriting of the EEPROM 134, and the like, for example.

The threshold value X is a value (for example, 25), which coincides with the threshold value A (for example, 80), or is a value slightly smaller than the threshold value A when the threshold value β (for example, 55) is added thereto. The threshold value X is used so as for the controller 130 to determine whether the corresponding cartridge 30 is in the ink-low state by comparing the same with the sensor count value, for example. The threshold value Y is a value (for example, 35), which coincides with the threshold value B (for example, 90), or is a value slightly smaller than the threshold value B when the threshold value β (for example, 55) is added thereto. Also, the threshold value Y is greater than the threshold value X.

The threshold value Y is used so as for the controller 130 to determine whether the corresponding cartridge 30 is in the empty state by comparing the same with the sensor count value, for example.

Figures 9A, 9B:
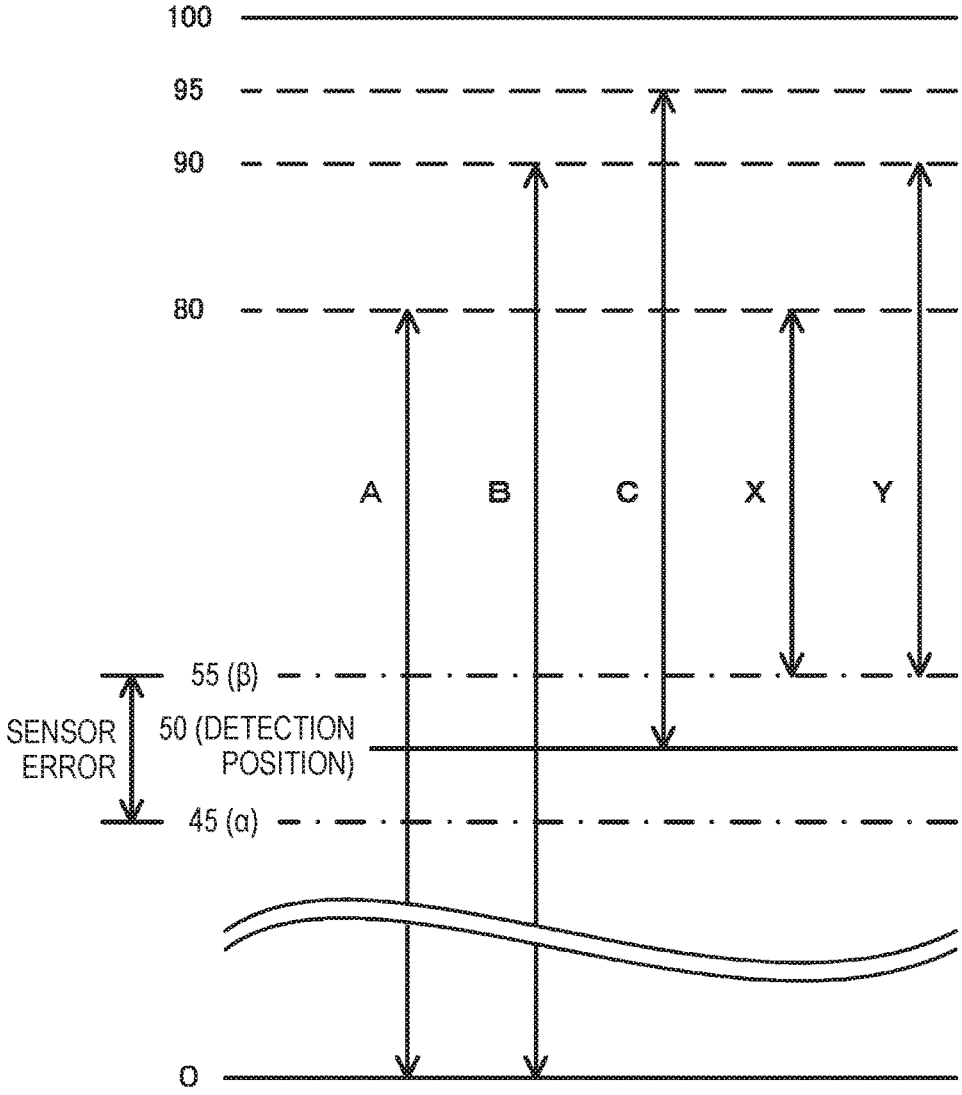
FIG. 9A depicts an example of a relation of threshold values A, B, C, X, Y, α, β.
FIG. 9B depicts an example of a relation of setting values of the threshold values A, B, C, X, Y and dischargeable amounts of ink.

In the meantime, the controller 130 starts the count-up of the ALL count value, when the corresponding cartridge 30 is mounted to the cartridge holder 100. For this reason, as shown in FIG. 9A, the amount of ink that can be discharged from the head 21 until the ALL count value reaches the threshold value A, B is constant for all the cartridges 30 having the same capacity. In the meantime, the controller 130 starts the count-up of the sensor count value, when the output of the corresponding remaining amount sensor 103 changes. For this reason, since the start timing of the count-up becomes different due to the sensor error, the amount of ink that can be discharged from the head 21 until the sensor count value reaches the threshold value C, X, Y is not uniform even for the cartridges 30 having the same capacity, as shown in FIG. 9A.

The CTG type information is information for indicating a type (hereinafter, referred to as "CTG type") of the cartridge 30 mounted to the cartridge holder 100. For the CTG type information, a first value (for example, 0) indicating that the CTG type is a first type or a second value (for example, 1) indicating that the CTG type is a second type is set. The first type indicates the cartridge 30 of which the detection error of the remaining amount sensor 103 is within the ranges of the threshold values α, β (i.e., the detection error is within a preset range), for example. The second type indicates the cartridge 30 of which the detection error of the remaining amount sensor 103 is beyond the ranges of the threshold values α, β (i.e., the detection error is beyond a preset range), for example.

(Operations of Printer 10)

Figure 6:
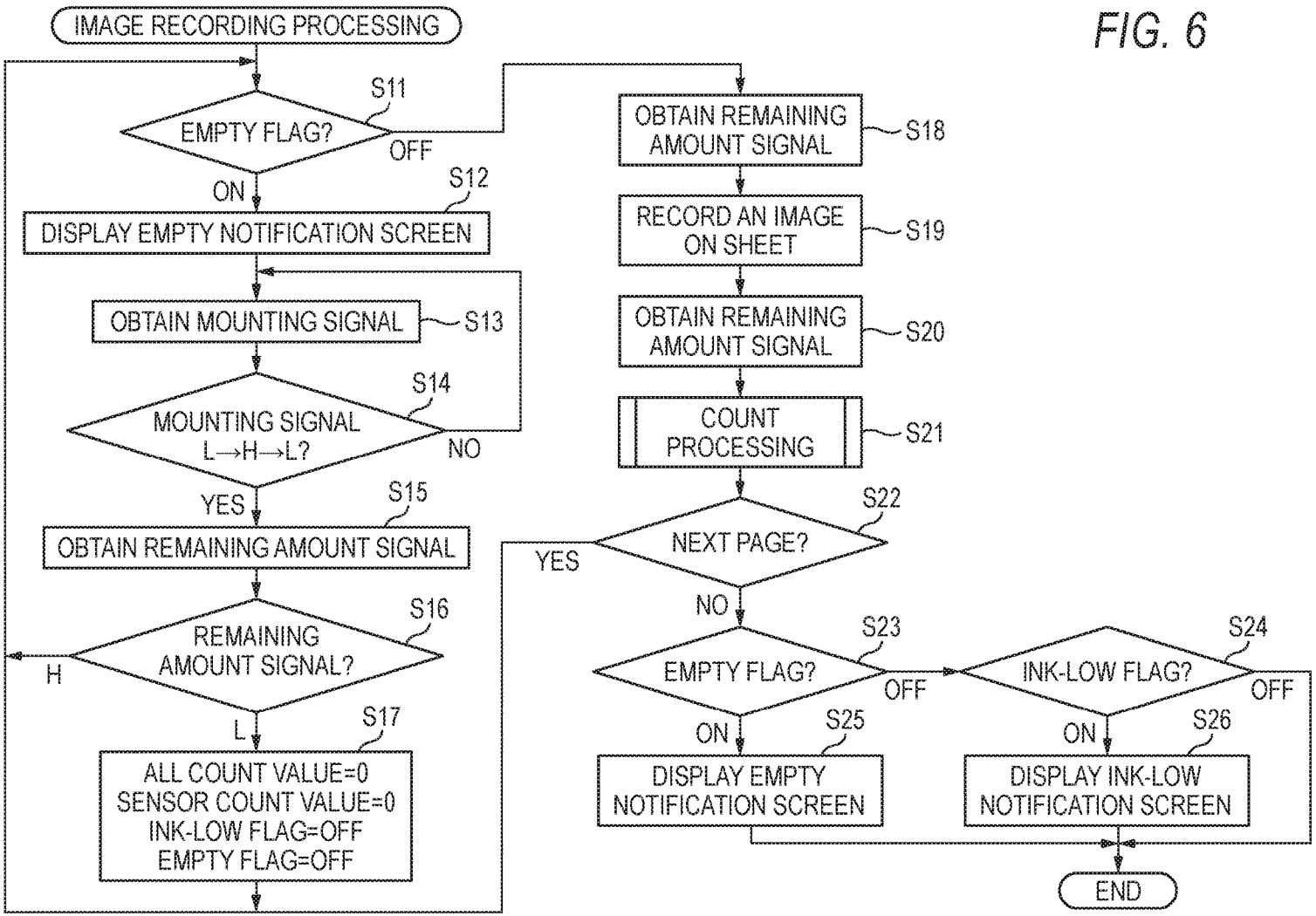
FIG. 6 is a flowchart of image recording processing.
Figure 7:
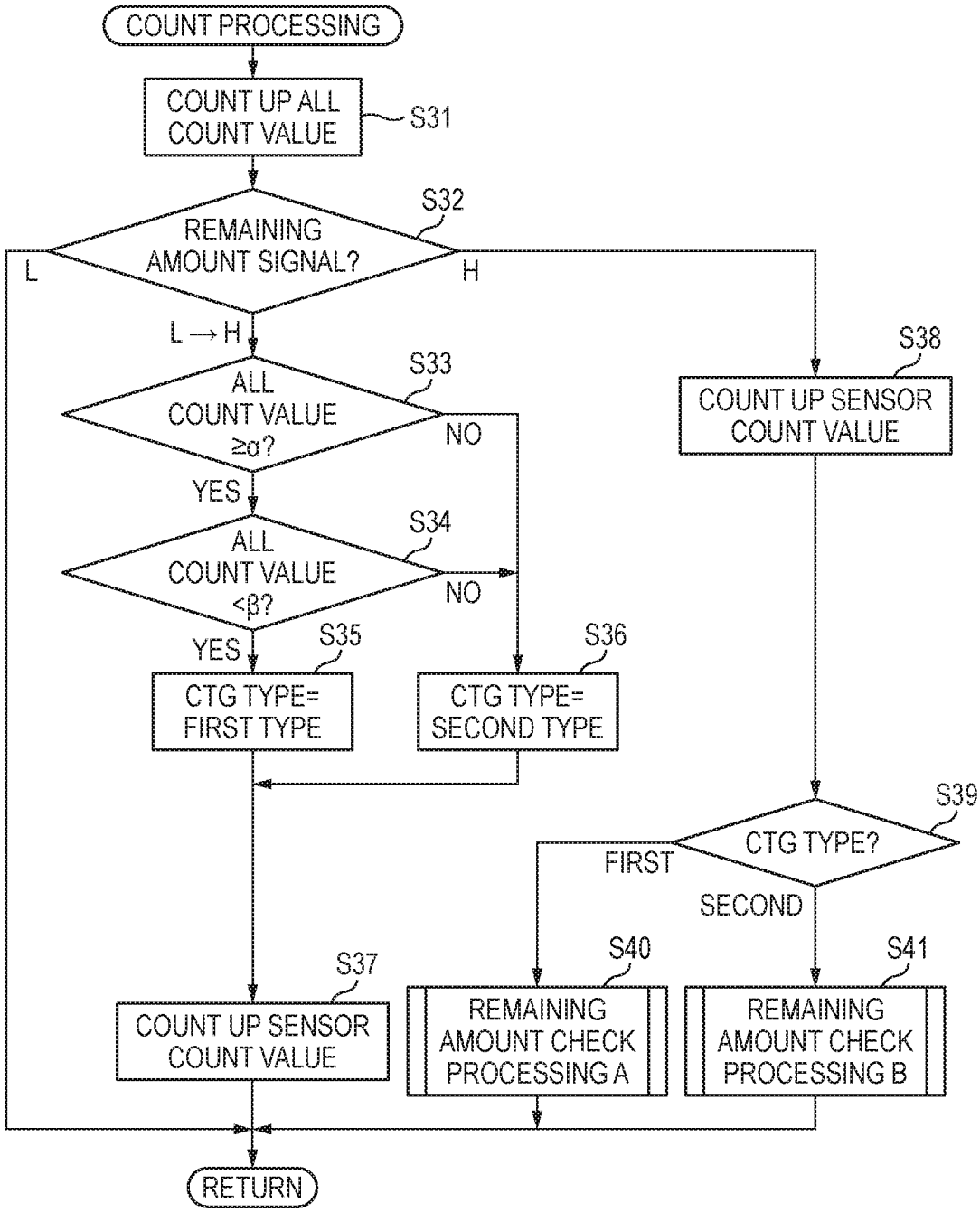
FIG. 7 is a flowchart of count processing.
Figure 8A:
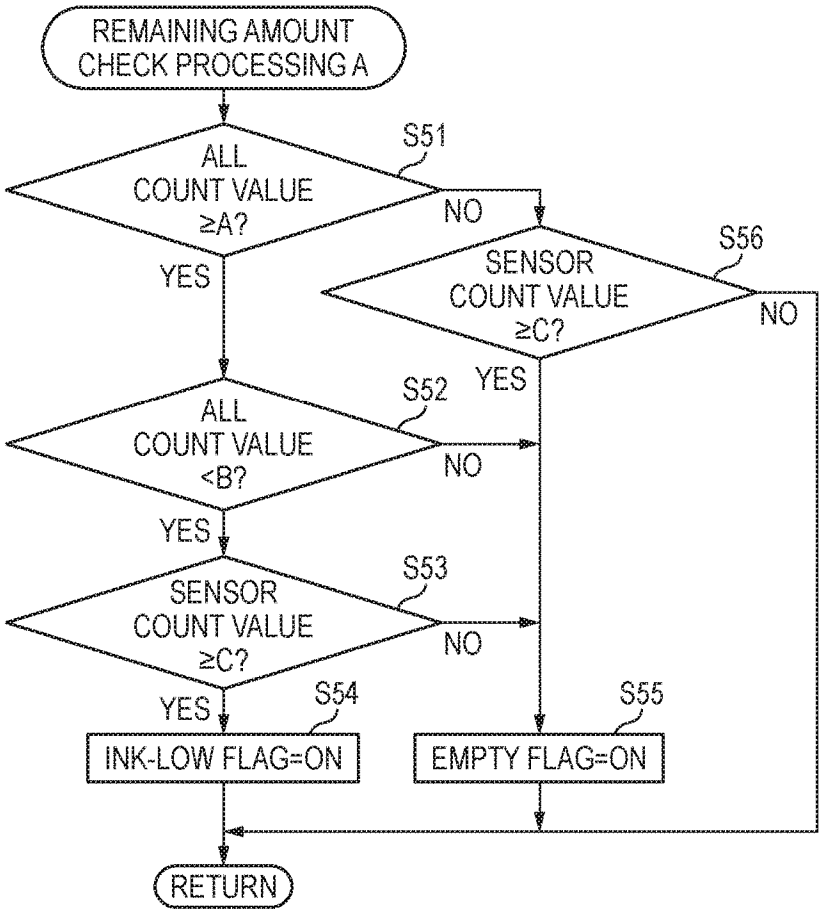
FIG. 8A is a flowchart of remaining amount check processing A.
Figure 8B:
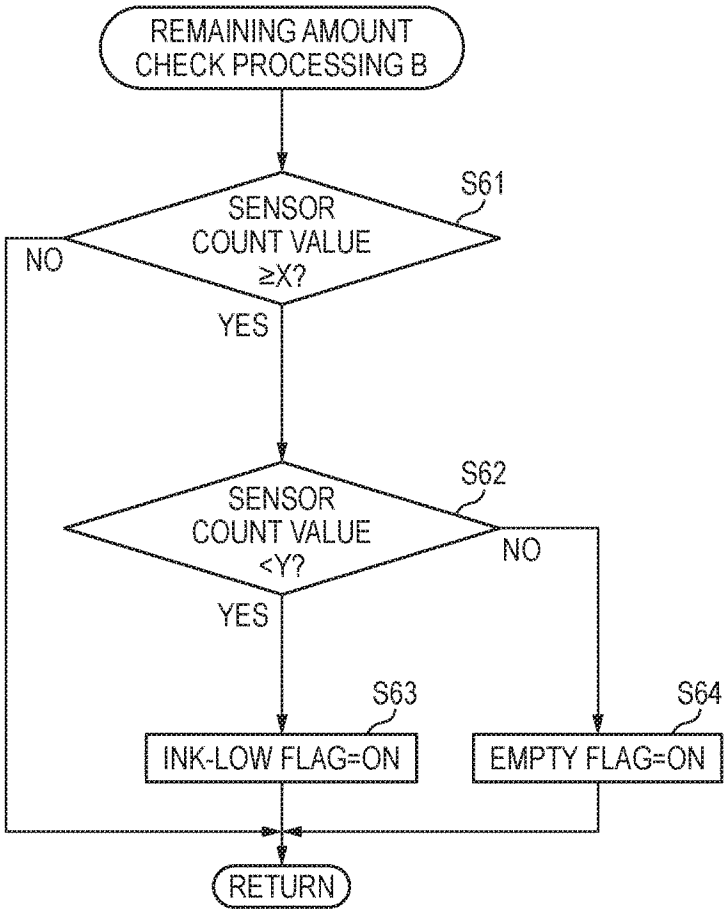
FIG. 8B is a flowchart of remaining amount check processing B.

Operations of the printer 10 of the illustrative embodiment are described with reference to FIGS. 6 to 8. Each processing of FIGS. 6 to 8 is executed by the CPU 131 of the controller 130. In the meantime, each processing to be described later may be executed by the CPU 131 reading out a program stored in the ROM 132 or may be implemented by a hardware circuit mounted on the controller 130. Also, an execution sequence of each processing may be appropriately changed without changing the gist of the disclosure.

(Image Recording Processing)

When a recording instruction is input to the printer 10, the controller 130 executes image recording processing shown in FIG. 6. The recording instruction is an example of the discharge instruction for enabling the printer 10 to execute recording processing of recording an image, which is expressed by image data, to a sheet. An obtaining source of the recording instruction is not particularly limited. For example, the recording instruction may be obtained from a user through an operation panel (not shown) or may be obtained from an external apparatus through a communication interface (not shown).

First, the controller 130 determines each setting value of the four empty flags (S11). When it is determined that "ON" is set for at least one of the four empty flags (S11: ON), the controller 130 displays an empty notification screen on the display 109 (S12). The empty notification screen is a screen for notifying the user that the recording processing cannot be continued (i.e., it is not possible to enable the head 21 to discharge the ink) if the cartridge 30 is not replaced. The empty notification screen may include a letter indicative of a color of ink retained in the cartridge 30 of the empty state, for example.

Then, the controller 130 repetitively obtains signals, which are output by the mounting sensor 107 corresponding to the cartridge 30 in which "ON" is set to the empty flag, every predetermined time interval. Then, the controller 130 continues to display the empty notification screen and stands by until the signals repetitively obtained from the mounting sensor 107 change from the low-level signal to the high-level signal and again change to the low-level signal (S13 & S14: No). The change of the output signal of the mounting sensor 107 from the low-level signal to the high-level signal corresponds to a case where the cartridge 30 in the empty state is demounted from the cartridge holder 100. Also, the change of the output signal of the mounting sensor 107 from the high-level signal to the low-level signal corresponds to a case where a new cartridge 30 is mounted to the cartridge holder 100. That is, the controller 130 stands by until the cartridge 30 is replaced.

Then, when replacement of the cartridge 30 in the empty state is detected on the basis of the output signal of the mounting sensor 107 (S14: Yes), the controller 130 obtains a signal that is output from the corresponding remaining amount sensor 103 (S15). The controller 130 determines whether the obtained signal of the remaining amount sensor 103 is a low-level signal (S16).

In the meantime, the specific processing of S16 is not limited to the above example. As another example, in S15, the controller 130 may read out ink amount information indicative of the amount of ink retained in the cartridge 30 from an IC chip (not shown) mounted on the cartridge 30. Then, the controller 130 may execute processing of S17 when the amount of ink indicated by the read ink amount information is equal to or greater than a threshold value. On the other hand, the controller 130 may execute processing of S11 and thereafter without executing the processing of S17 when the amount of ink indicated by the read ink amount information is smaller than the threshold value.

Subsequently, when it is determined that the output signal of the remaining amount sensor 103 is a low-level signal (i.e., the ink is retained in the newly mounted cartridge 30) (S16: L), the controller 130 executes processing of S17. In S17, the controller 130 assigns the initial values to the corresponding ALL count value, sensor count value, ink-low flag, and empty flag (S17), and again executes the processing of S11 and thereafter. On the other hand, when it is determined that the output signal of the remaining amount sensor 103 is a high-level signal (i.e., the ink is not retained in the newly mounted cartridge 30) (S16: H), the controller 130 again executes the processing of S11 and thereafter without executing the processing of S17.

Then, when it is determined that "ON" is set to at least one of the four empty flags after executing the processing of S12 and thereafter (S11: ON), the controller 130 again executes the processing of S12 and thereafter. On the other hand, when it is determined that "OFF" is set to all of the four empty flags (S11: OFF), the controller 130 obtains the signals, which are output at the present time from each of the four remaining amount sensors 103, and stores information, which indicates that the obtained signals are low-level or high-level signals, in the RAM 133 (S18).

Then, the controller 130 records an image, which is expressed by the image data included in the recording instruction, to a sheet (S19). More specifically, the controller 130 enables the feeder roller 23 and the conveyance roller unit 25 to convey the sheet on the feeding tray 15, the head 21 to discharge the ink, and the discharge roller unit 27 to convey the sheet. Thereby, an image is recorded on the sheet, and the sheet having the image recorded thereon is conveyed toward the discharge tray 16.

From the above, when "OFF" is set to all of the four the empty flags, the controller 130 permits the discharge of ink. On the other hand, when "ON" is set to at least one of the four the empty flags, the controller 130 prohibits the discharge of ink.

Subsequently, when the image is recorded on the sheet in accordance with the recording instruction, the controller 130 obtains the signals output from each of the four remaining amount sensors 103 at the present time, and stores information, which indicates that the obtained signals are the low-level or high-level signals, in the RAM 133 (S20). Then, the controller 130 executes count processing to be described later (S21). Then, the controller 130 repetitively executes the processing of S11 to S21 until all images indicated by the recording instruction are recorded on the sheets (S22: Yes). When all images indicated by the recording instruction are recorded on the sheets (S22: No), the controller 130 determines the setting values of the empty flag and the ink-low flag (S23, S24).

When it is determined that "ON" is set to at least one of the four empty flags (S23: ON), the controller 130 displays the empty notification screen on the display 109 (S25). Also, when it is determined that "OFF" is set to all of the four empty flags and "ON" is set to at least one of the four ink-low flags (S23: OFF&S24: ON), the controller 130 displays an ink-low notification screen on the display 109 (S26). The processing of S25 and S26 is an example of the processing of operating the notification device.

The empty notification screen displayed in S25 may be similar to that displayed in S12. Also, the ink-low notification screen is a screen for notifying the user that the cartridge 30 is in the ink-low state. The ink-low notification screen may include a letter indicative of a color of ink retained in the cartridge 30 of the ink-low state, for example. On the other hand, when it is determined that "OFF" is set to all of the four empty flags and the four ink-low flags (S24: OFF), the controller 130 ends the image recording processing without executing the processing of S25 and S26.

In the meantime, the specific example of the discharge instruction is not limited to the recording instruction, and may be a maintenance instruction for instructing maintenance of the nozzles 29, for example. When the maintenance instruction is obtained, for example, the controller 130 executes processing similar to FIG. 6. A difference between the processing that is executed when the maintenance instruction is obtained and the above processing is described. First, in S19, the controller 130 drives a maintenance mechanism (not shown) to discharge the ink through the nozzles 29. Also, after executing count processing, the controller 130 executes the processing of S23 and thereafter without executing the processing of S22.

(Count Processing)

In the below, the count processing that is executed by the controller 130 in S21 is described in detail with reference to FIG. 7. The count processing is processing of updating the ALL count value and the sensor count value to values equivalent to the amount of ink that is instructed to be discharged through the head 21 in accordance with the image data, the maintenance instruction or the like included in the recording instruction.

First, the controller 130 counts up the corresponding ALL count value to a value equivalent to the amount of ink that has been instructed to be discharged in last S19 (S31). That is, the controller 130 individually counts up the ALL count values of black ink, cyan ink, magenta ink, and yellow ink. Also, when the image is recorded on the sheet in S19, the controller 130 counts up the ALL count value to a value equivalent to an amount of ink of one page.

Then, the controller 130 compares the information, which indicates the signals of the remaining amount sensor 103 stored in the RAM 133 from the same remaining amount sensor 103 in S18 and S20, for each of the four remaining amount sensors 103 (S32). That is, the controller 130 determines whether the signal of each of the four remaining amount sensors 103 has changed before and after executing the processing of last S19. The change of the signal of the remaining amount sensor 103 corresponds to a case where the liquid level of the corresponding cartridge 30 is below the detection position P.

When it is determined that all the information stored in the RAM 133 in S18 and S20 indicates the low-level signal (i.e., the output of the remaining amount sensor 103 has not changed) (S32: L), the controller 130 ends the count processing. That is, the controller 130 does not execute processing of S33 to S41 (which will be described later) in which the ALL count value, sensor count value, and CTG information corresponding to the cartridge 30 are used. That is, in the count processing that is executed for the cartridge 30 in which the liquid level is the detection position P or higher, only the ALL count value is updated.

Also, when it is determined that the information stored in the RAM 133 in S18 indicates the low-level signal and the information stored in the RAM 133 in S20 indicates the high-level signal (i.e., the output of the remaining amount sensor 103 has changed) (S32: L→H), the controller 130 executes processing of S33 and thereafter. That is, the controller 130 executes processing of S33 to S37 by using the ALL count value, sensor count value, and CTG type information corresponding to the cartridge 30 in which the liquid level is below the detection position P.

The controller 130 compares the ALL count value updated in last S31 and the threshold values $\alpha$, $\beta$ (S33, S34). When it is determined that the ALL count value is equal to or greater than the threshold value $\alpha$ and is smaller than the threshold value $\beta$ (S33: Yes & S34: Yes), the controller 130 assigns the first value to the corresponding CTG type information (S35). On the other hand, when it is determined that the ALL count value is smaller than the threshold value $\alpha$ (S33: No) or the ALL count value is equal to or greater than the threshold value $\beta$ (S34: No), the controller 130 assigns the second value to the corresponding CTG type information (S36). Also, the controller 130 counts up the corresponding sensor count value to a value (i.e., a value added to the corresponding ALL count value in last S31) equivalent to the amount of ink that has been instructed to be discharged in last S19 (S37).

That is, in the count processing that is executed for the cartridge 30 of which the output of the remaining amount sensor 103 has changed during the processing of last S19, the CTG type is determined and the count-up of the sensor count value starts. In the meantime, the ALL count value is updated to a value equivalent to a total amount of ink, which has been instructed to be discharged in last S19, in S31. For this reason, the ALL count value is slightly different from the ALL count value upon the change of the output of the remaining amount sensor 103. However, since the difference is small, the ALL count value updated in S31 is treated as the ALL count value upon the change of the output of the remaining amount sensor 103.

Also, when it is determined that all the information stored in the RAM 133 in S18 and S20 indicates the high-level signal (S32: H), the controller 130 executes processing of S38 and thereafter. That is, the controller 130 executes processing of S38 to S41 by using the ALL count value, sensor count value, and CTG type information corresponding to the cartridge 30 in which the liquid level has been already below the detection position P in an ideal state. In the meantime, a value has been already assigned to the CTG type information corresponding to the cartridge 30, in the previous count processing (S35, S36).

The controller 130 counts up the corresponding sensor count value to a value (i.e., a value added to the corresponding ALL count value in last S31) equivalent to the amount of ink that has been instructed to be discharged in last S19 (S38). When it is determined that the first value has been assigned to the corresponding CTG type information (S39: first), the controller 130 executes remaining amount check processing A (S40). On the other hand, when it is determined that the second value has been assigned to the corresponding CTG type information (S39: second), the controller 130 executes remaining amount check processing B (S41).

That is, the count processing is executed for each cartridge 30 whenever the ink is discharged through the head 21. For example, in the case of one cartridge 30, only the ALL count value is updated for a while after the cartridge is mounted to the cartridge holder 100 (S31→S32: L), the processing of S33 to S37 is just once executed at timing at which the output signal of the remaining amount sensor 103 has changed (S32: L→H), and then the processing of S38 to S41 is then executed until the cartridge becomes in the empty state (S32: H).

(Remaining Amount Check Processing A)

The remaining amount check processing A is processing in which the controller 130 checks the remaining amount of ink by mainly using the ALL count value for the cartridge 30 (i.e., the first type of the cartridge 30) of which the detection error of the remaining amount sensor 103 is within the preset range. The remaining amount check processing A is described in detail with reference to FIG. 8A.

First, the controller 130 compares the ALL count value corresponding to the cartridge 30 and the threshold values A, B (S51, S52). In other words, the controller 130 determines a state of the cartridge 30 (the ink-low state, the empty state or a state that is neither the ink-low state nor the empty state) by using the ALL count value. Also, the controller 130 compares the sensor count value corresponding to the cartridge 30 and the threshold value C (S53, S56).

When it is determined that the ALL count value is equal to or greater than the threshold value A and smaller than the threshold value B (S51: Yes & S52: Yes) and the sensor count value is smaller than the threshold value C (S53: No), the controller 130 assigns "ON" to the corresponding ink-low flag (S54). That is, in this case, since it is thought that the ALL count value has been appropriately updated, the controller 130 assigns "ON" to the ink-low flag on the basis of the appropriately updated ALL count value.

Also, when it is determined that the ALL count value is equal to or greater than the threshold value A and smaller than the threshold value B (S51: Yes & S52: Yes) and the sensor count value is equal to or greater than the threshold value C (S53: Yes), the controller 130 assigns "ON" to the corresponding empty flag (S55). In case that the detection error is within the preset range, when the ALL count value is equal to or greater than the threshold value A and smaller than the threshold value B, the sensor count value does not normally reach the threshold value C. However, when the ALL count value is equal to or greater than the threshold value A and smaller than the threshold value B but the sensor count value reaches the threshold value C, it is thought that the ALL count value has not been appropriately updated. In the meantime, the air-in should be prevented. Therefore, in this case, the controller 130 assigns "ON" to the empty flag so as to prohibit the discharge of ink through the nozzles 29.

Also, when it is determined that the ALL count value is equal to or greater than the threshold value B (S51: Yes & S52: No), the controller 130 assigns "ON" to the corresponding empty flag (S55). In this case, since "ON" is assigned to the empty flag and the discharge of ink is thus thereafter prohibited, the processing of comparing the sensor count value and the threshold value C can be omitted.

Also, when it is determined that the ALL count value is smaller than the threshold value A (S51: No) and the sensor count value is equal to or greater than the threshold value C (S56: Yes), the controller 130 assigns "ON" to the corresponding empty flag (S55). In case that the detection error is within the preset range, when the ALL count value is smaller than the threshold value A, the sensor count value does not normally reach the threshold value C. However, when the ALL count value is smaller than the threshold value A but the sensor count value reaches the threshold value C, it is thought that the ALL count value has not been appropriately updated. In the meantime, the air-in should be prevented. Therefore, in this case, the controller 130 assigns "ON" to the empty flag so as to prohibit the discharge of ink through the nozzles 29.

Also, when it is determined that the ALL count value is smaller than the threshold value A (S51: No) and the sensor count value is smaller than the threshold value C (S56: No), the controller 130 ends the remaining amount check processing A without executing processing of S54 and S55. As described above, in case that the detection error is within the preset range, when the ALL count value is smaller than the threshold value A, the sensor count value does not normally reach the threshold value C. Therefore, in this case, it is thought that the ALL count value has been appropriately updated.

(Remaining Amount Check Processing B)

The remaining amount check processing B is processing in which the controller 130 checks the remaining amount of ink by using the sensor count value for the cartridge 30 (i.e., the second type of the cartridge 30) of which the detection error of the remaining amount sensor 103 is beyond the preset range. The remaining amount check processing B is described in detail with reference to FIG. 8A.

First, the controller 130 compares the sensor count value corresponding to the cartridge 30 and the threshold values X, Y (S61, S62). A magnitude relation between the sensor count value and the threshold values A, B corresponds to a state of the cartridge 30 (the ink-low state, the empty state or a state that is neither the ink-low state nor the empty state)

When it is determined that the sensor count value is smaller than the threshold value X (S61: No), the controller 130 ends the remaining amount check processing B without executing processing of S63 and S64. The case where the sensor count value is smaller than the threshold value X corresponds to a case where a sufficient amount of ink remains in the cartridge 30.

Also, when it is determined that the sensor count value is equal to or greater than the threshold value X and smaller than the threshold value Y (S61: Yes & S62: Yes), the controller 130 assigns "ON" to the corresponding ink-low flag (S63). The case where the sensor count value is equal to or greater than the threshold value X and smaller than the threshold value Y corresponds to a case where the cartridge 30 is in the ink-low state.

Also, when it is determined that the sensor count value is equal to or greater than the threshold value Y (S62: No), the controller 130 assigns "ON" to the corresponding empty flag (S64). The case where the sensor count value is equal to or greater than the threshold value Y corresponds to a case where the cartridge 30 is in the empty state.

Advantages of Illustrative Embodiment

According to the above illustrative embodiment, for the cartridge 30 of which the ALL count value upon the change of the output of the remaining amount sensor 103 is within the ranges of the threshold values α, β, the display timing of the ink-low notification screen or the empty notification screen (in the below, collectively referred to as "notification screen") is determined using the ALL count value. As a result, the printer 10 can notify the state of the cartridge 30 at appropriate timing without being influenced by the detection error of the remaining amount sensor 103.

In the meantime, in the case of the cartridge 30 of which the ALL count value upon the change of the output of the remaining amount sensor 103 is beyond the ranges of the threshold values α, β, it is not clear how many ink is retained in the cartridge at a point of time at which the cartridge is mounted to the cartridge holder 100. Therefore, like the illustrative embodiment, for the corresponding cartridge 30, it is preferable to determine the display timing of the notification screen by using the sensor count value.

When a difference between the initial value of the sensor count value and the threshold value X is made smaller than a difference between the ALL count value upon the change of the output of the remaining amount sensor 103 and the threshold value A, following operational effects are achieved. That is, the amount of ink that can be discharged after the output of the remaining amount sensor 103 changes until the notification screen is displayed is always larger in the first type of the cartridge 30 than in the second type of the cartridge 30, irrespective of whether or not the detection error of the remaining amount sensor 103. In other words, the amount of ink that remains in the liquid chamber 31 at the display timing of the notification screen is always larger in the first type of the cartridge 30 than in the second type of the cartridge 30. That is, it is possible to discharge the ink in the first type of the cartridge without waste.

According to the above illustrative embodiment, before the ALL count value reaches the threshold value B and the discharge of liquid by the head 21 is thus prohibited, the ink-low notification screen is displayed in advance at a stage where the ALL count value reaches the threshold value A. Likewise, before the sensor count value reaches the threshold value Y and the discharge of liquid by the head 21 is thus prohibited, the ink-low notification screen is displayed in advance at a stage where the sensor count value reaches the threshold value X. As a result, since the user is provided with a chance to prepare a new cartridge, an availability factor of the printer is improved.

The ALL count value that is to be counted by software may be unexpectedly returned to the initial value thereof by unintentional overwriting of the EEPROM 134, for example. According to the above illustrative embodiment, since the empty notification screen is displayed and the discharge of liquid is prohibited at timing at which the sensor count value reaches the threshold value C, the control using the ALL count value is complemented.

According to the above illustrative embodiment, since the detection object 53 of the sensor arm 50 configured to rotate in the liquid chamber 31 is detected with the remaining amount sensor 103, the detection error of the remaining amount sensor 103 of each cartridge 30 is likely to increase. That is, when the disclosure is applied to the printer 10 to which the cartridge 30 having the sensor arm 50 is detachably mounted, it is possible to achieve the particularly favorable effects. However, the specific example of the detection object 53 is not limited thereto, and may be a prism or the like of which an optical refraction index changes in correspondence to the ink in the cartridge 30. Also, the detection object 53 is not required to be necessarily disposed in the cartridge 30, and may be provided to the cartridge holder 100.

In the above illustrative embodiment, the ALL count value upon the change of the output of the remaining amount sensor 103 and the threshold values α, β are compared to determine whether the cartridge 30 is the first type or the second type. However, one of S33 and S34 may be omitted. For example, when the processing of S34 is omitted and the ALL count value is equal to or greater than the threshold value α, the controller 130 may assign the first value to the CTG type information (S33: Yes→S35), and when the ALL count value is smaller than the threshold value α, the controller may assign the second value to the CTG type information (S33: No→S35). The case where the ALL count value upon the change of the output of the remaining amount sensor 103 is smaller than the threshold value α may be a case where the used cartridge 30 is mounted, for example.

In the above illustrative embodiment, when the ALL count value upon the change of the output of the remaining amount sensor 103 is smaller than the threshold value α and when ALL count value is equal to or greater than the threshold value β, the processing thereafter is commonly executed. However, when the ALL count value is smaller than the threshold value α, and when the ALL count is equal to or greater than the threshold value β, the processing thereafter may be different. For example, when the ALL count value upon the change of the output of the remaining amount sensor 103 is equal to or greater than the threshold value β, the controller 130 may assign the first value to the CTG type information.

In the case of the cartridge 30 of which the ALL count value upon the change of the output of the remaining amount sensor 103 reaches the threshold value β, the amount of ink first retained in the cartridge 30 is not clear, and the reliability of the sensor arm 50 is also doubtful. Therefore, for the cartridge 30, the display timing of the notification screen is preferably determined using the ALL count value. As another example, when the ALL count value upon the change of the output of the remaining amount sensor 103 is equal to or greater than the threshold value β, the controller 130 may assign "ON" to the empty flag (i.e., prohibit the discharge of ink), notify the user that the amount of ink in the cartridge 30 is not clear, through the display 109 or may combine both the configurations.

In the above illustrative embodiment, the printer 10 in which the cartridge 30 is detachably mounted to the cartridge holder 100 has been described as an example of the liquid discharge apparatus. Alternatively, the printer 10 may include a tank configured to retain therein the ink (liquid), instead of the cartridge holder 100. The tank may include a liquid chamber configured to retain therein the ink, and an injection port for injecting the ink into the liquid chamber from an outside of the tank. The head 21 may be configured to communicate with the liquid chamber of the tank through the tube 20. For example, the tank may be configured by a combination of the cartridge holder 100 and the cartridge 30 shown in FIG. 3 and may be provided with the remaining amount sensor 103, but the mounting sensor 107 may be omitted.

The controller 130 may be configured to update the ALL count value to a value equivalent to the amount of liquid that is instructed to be discharged by a discharge instruction, after the ink is injected into the tank through the injection port. More specifically, when it is detected that the ink is injected into the tank through the injection port, the controller 130 may execute the processing of S17, instead of the processing of S13 to S16. The ink injection into the tank may be detected with a remaining amount sensor provided to the tank or an input of the user received through an operation panel (not shown).

In the above illustrative embodiment, the ink has been described as an example of the liquid. However, the liquid may be a pre-processing liquid that is to be discharged to a sheet or the like prior to the ink upon recording of an image, or may be water for cleaning the head 21.

The disclosure can be interpreted not only as an apparatus in which the controller 130 executes the above processing but also as a method by which the controller of the liquid discharge apparatus determines the amount of liquid in the cartridge mounted to the cartridge holder of the liquid discharge apparatus. In the method, the head configured to communicate with the liquid chamber of the cartridge mounted to the cartridge holder is enabled to discharge the liquid in accordance with the discharge instruction to discharge the liquid, the first count value is updated to a value corresponding to the amount of liquid, which is instructed to be discharged by the discharge instruction, in the direction of approximating to the threshold value A after the cartridge is mounted to the cartridge holder, the signal, which changes when the liquid level in the liquid chamber of the cartridge becomes lower than the detection position, is obtained from the remaining amount sensor, when the first count value upon the change of the obtained signal reaches the threshold value α, the cartridge mounted to the cartridge holder is determined as the first type, and when the first count value additionally updated after the change of the signal reaches the threshold value A, the notification device of the liquid discharge apparatus is operated on the basis of the determination that the cartridge mounted to the cartridge holder is the first type. The threshold value A is a value more distant from the initial value of the first count value than the threshold value α.

As discussed above, the disclosure may provide at least the following illustrative, non-limiting embodiments.

(1) A liquid discharge apparatus comprising: a cartridge holder configured to receive a cartridge, the cartridge comprising a liquid chamber retaining liquid; a remaining amount sensor; a head configured to communicate with the liquid chamber of the cartridge mounted to the cartridge holder; a notification device; and a controller configured to: control the head to discharge the liquid in accordance with a discharge instruction to discharge the liquid; update a first count value to a value corresponding to an amount of liquid instructed to be discharged by the discharge instruction after the cartridge is mounted to the cartridge holder, the first count value being updated in a direction of approximating to a threshold value A; obtain a first signal from the remaining amount sensor, the first signal being output by the remaining amount sensor in a case where a liquid level in the liquid chamber of the cartridge mounted to the cartridge holder is a detection position or higher; obtain a second signal from the remaining amount sensor after the receiving of the first signal, the second signal being output by the remaining amount sensor in a case where the liquid level in the liquid chamber of the cartridge mounted to the cartridge holder is lower than the detection position; and in a case where the first count value upon the receiving of the second signal reaches a threshold value α, control the notification device to perform notification in response to an updated first count value updated after the receiving of the second signal reaching the threshold value A, wherein the threshold value A is more distant from an initial value of the first count value than the threshold value α.

According to the above configuration, for the cartridge of which the first count value upon the receiving of the second signal from the remaining amount sensor reaches the threshold value α, the operating timing of the notification device is determined using the first count value, which is an integration value of a discharged amount of liquid after the cartridge is mounted to the cartridge holder. As a result, the liquid discharge apparatus can operate the notification device at appropriate timing without being influenced by a detection error of the remaining amount sensor.

(2) The liquid discharge apparatus of (1), wherein in a case where the first count value upon the receiving of the second signal reaches the threshold value α and does not reach a threshold value β, the controller is configured to control the notification device to perform the notification in response to the updated first count value reaching the threshold value A, and wherein the threshold value β is more distant from the initial value of the first count value than the threshold value α.

According to the above configuration, the liquid discharge apparatus can operate the notification device at appropriate timing without being influenced by a detection error of the remaining amount sensor, for the cartridge of which the first count value upon the receiving of the second signal from the remaining amount sensor is within ranges of the threshold values α and β.

(3) The liquid discharge apparatus of (2), wherein in a case where the first count value upon the receiving of the second signal does not reach the threshold value α or the first count value upon the receiving of the second signal reaches the threshold value β, the controller is configured to: update a second count value to a value corresponding to an amount of liquid instructed to be discharged by the discharge instruction after the second signal is received, the second count value being updated in a direction of approximating to a threshold value X; and control the notification device to perform the notification in response to the updated second count value reaching the threshold value X.

Like the above configuration, in the case of a cartridge of which the first count value upon the receiving of the second signal from the remaining amount sensor is not within the ranges of the threshold values a and β, it is not clear how many the liquid is retained at a point of time at which the cartridge is mounted to the cartridge holder. Therefore, for the corresponding cartridge, the operating timing of the notification device is preferably determined using the second count value, which is an integration value of the discharged amount of liquid after the second signal is received from the remaining amount sensor.

(4) The liquid discharge apparatus of (3), further comprising a memory storing therein any one of a first value and a second value, wherein the controller is configured to: store the first value in the memory in a case where the first count value upon the receiving of the second signal reaches the threshold value α and does not reach the threshold value β; store the second value in the memory in a case where the first count value upon the receiving of the second signal does not reach the threshold value α or the first count value upon the receiving of the second signal reaches the threshold value β; in a case where the memory stores the first value, control the notification device to perform the notification in response to the updated first count value reaching the threshold value A; and in a case where the memory stores the second value, control the notification device to perform the notification in response to the updated second count value reaching the threshold value X.

(5) The liquid discharge apparatus of (3) or (4), wherein a difference between an initial value of the second count value and the threshold value X is smaller than a difference between the first count value upon the receiving of the second signal and the threshold value A.

According to the above configuration, the amount of ink, which can be discharged after the second signal is received from the remaining amount sensor until the notification device operates, is larger in the first type of the cartridge than in the second type of the cartridge, irrespective of whether or not the detection error of the remaining amount sensor. In other words, the amount of the liquid that remains in the liquid chamber at timing at which the notification device has operated is always larger in the first type of the cartridge than in the second type of the cartridge. That is, it is possible to discharge the ink in the liquid chamber of the first type of the cartridge without waste.

(6) The liquid discharge apparatus of any one of (3) to (5), wherein the controller is further configured to prohibit discharge of the liquid from the head in response to the updated second count value reaching a threshold value Y, and wherein the threshold value Y is more distant from an initial value of the second count value than the threshold value X.

According to the above configuration, before the second count value reaches the threshold value Y and the discharge of liquid by the head is thus prohibited, the notification device is operated in advance at a stage where the second count value reaches the threshold value X. As a result, since a user is provided with a chance to prepare a new cartridge, an availability factor of the liquid discharge apparatus is improved.

(7) The liquid discharge apparatus of any one of (2) to (6), wherein a range indicated by the threshold value α and a range indicated by the threshold value β are received by adding and subtracting a detection error of the remaining amount sensor to and from a preset value, the preset value being corresponding to an amount of liquid that is to be retained in the liquid chamber of the cartridge upon the receiving of the second signal.

(8) The liquid discharge apparatus of any one of (1) to (7), wherein the controller is further configured to prohibit discharge of the liquid from the head in response to the updated first count value reaching a threshold value B, and wherein the threshold value B is more distant from the initial value of the first count value than the threshold value A.

According to the above configuration, before the first count value reaches the threshold value B and the discharge of liquid by the head is thus prohibited, the notification device is operated in advance at a stage where the first count value reaches the threshold value A. As a result, since the user is provided with a chance to prepare a new cartridge, the availability factor of the liquid discharge apparatus is improved.

(9) The liquid discharge apparatus of (8), wherein the controller is further configured to: in a case where the first count value upon the receiving of the second signal reaches the threshold value α, update a second count value to a value corresponding to an amount of liquid instructed to be discharged by the discharge instruction after the second signal is received, the second count value being updated in a direction of approximating to a threshold value X; and control the notification device to perform the notification and prohibit discharge of the liquid from the head in response to the updated second count value reaching a threshold value C, and wherein a difference between an initial value of the second count value and the threshold value C is smaller than a difference between the first count value upon the receiving of the second signal and the threshold value A.

The first count value that is to be counted by software may be unexpectedly returned to an initial value by unintentional overwriting of the memory, for example. Therefore, according to the above configuration, since the notification device is operated and the discharge of liquid is prohibited at timing at which the second count value reaches the threshold value C, the control using the first count value is complemented. In the meantime, when a relation of the first count value, the second count value, and the threshold values A, B is set as described above, the first count value reaches the threshold value A earlier than the second count value reaches the threshold value C if there is no such a trouble that the first count value is overwritten, for example. That is, the control using the second count value is used as a fail-safe.

(10) The liquid discharge apparatus of any one of (1) to (9), wherein the cartridge further comprises a detection object, the detection object being locatable at a first position when the liquid level in the liquid chamber of the cartridge mounted to the cartridge holder is the detection position or higher, the detection object being locatable at a second position when the liquid level is lower than the detection position, the second position being different from the first position, and wherein the remaining amount sensor is configured to: output the first signal when the detection object is located at the first position; and output the second signal when the detection object is located at the second position.

The detection object may have a float configured to move by buoyancy, which changes in correspondence to the amount of liquid in the cartridge, for example, and may be a prism or the like of which an optical refraction index changes in correspondence to the amount of liquid in the cartridge. Also, the detection object is not required to be necessarily disposed in the cartridge, and may be provided to the cartridge holder.

(11) A liquid discharge apparatus comprising: a cartridge holder configured to receive a cartridge, the cartridge comprising a liquid chamber retaining liquid; a remaining amount sensor; a head configured to communicate with the liquid chamber of the cartridge mounted to the cartridge holder; a notification device; and a controller configured to: control the head to discharge the liquid in accordance with a discharge instruction to discharge the liquid; update a first count value to a value corresponding to an amount of liquid instructed to be discharged by the discharge instruction after the cartridge is mounted to the cartridge holder, the first count value being updated in a direction of approximating to a threshold value A; obtain a first signal from the remaining amount sensor, the first signal being output by the remaining amount sensor in a case where a liquid level in the liquid chamber of the cartridge mounted to the cartridge holder is a detection position or higher; obtain a second signal from the remaining amount sensor after the receiving of the first signal, the second signal being output by the remaining amount sensor in a case where the liquid level in the liquid chamber of the cartridge mounted to the cartridge holder is lower than the detection position; and in a case where the first count value upon the receiving of the second signal reaches a threshold value β, control the notification device to perform notification in response to an updated first count value updated after the receiving of the second signal reaching the threshold value A, wherein the threshold value A is more distant from an initial value of the first count value than the threshold value β.

In the case of a cartridge of which the first count value upon the receiving of the second signal from the remaining amount sensor reaches the threshold value β, the amount of liquid first retained in the cartridge is not clear, and the reliability of the remaining amount sensor is also doubtful. Therefore, for the corresponding cartridge, the operating timing of the notification device is preferably determined using the first count value.

(12) A liquid discharge apparatus comprising: a tank configured to receive liquid injected from an outside, the tank comprising a liquid chamber configured to retain the injected liquid; a remaining amount sensor; a head communicating with the liquid chamber of the tank; a notification device; and a controller configured to: control the head to discharge the liquid in accordance with a discharge instruction to discharge the liquid; update a first count value to a value corresponding to an amount of liquid instructed to be discharged by the discharge instruction after the liquid is injected into the liquid chamber of the tank, the first count value being updated in a direction of approximating to a threshold value A; obtain a first signal from the remaining amount sensor, the first signal being output by the remaining amount sensor in a case where a liquid level in the liquid chamber of the tank is a detection position or higher; obtain a second signal from the remaining amount sensor after the receiving of the first signal, the second signal being output by the remaining amount sensor in a case where the liquid level in the liquid chamber of the tank is lower than the detection position; and in a case where the first count value upon the receiving of the second signal reaches a threshold value α, control the notification device to perform notification in response to an updated first count value updated after the receiving of the second signal reaching the threshold value A, wherein the threshold value A is more distant from an initial value of the first count value than the threshold value α.

(13) The liquid discharge apparatus of (12), wherein in a case where the first count value upon the receiving of the second signal reaches the threshold value α and does not reach a threshold value β, the controller is configured to control the notification device to perform the notification in response to the updated first count value reaching the threshold value A, and wherein the threshold value β is more distant from the initial value of the first count value than the threshold value α.

(14) The liquid discharge apparatus of (13), wherein in a case where the first count value upon the receiving of the second signal does not reach the threshold value α or the first count value upon the receiving of the second signal reaches the threshold value β, the controller is configured to: update a second count value to a value corresponding to an amount of liquid instructed to be discharged by the discharge instruction after the second signal is received, the second count value being updated in a direction of approximating to a threshold value X; and control the notification device to perform the notification in response to the updated second count value reaching the threshold value X.

(15) The liquid discharge apparatus of (14), wherein a difference between an initial value of the second count value and the threshold value X is smaller than a difference between the first count value upon the receiving of the second signal and the threshold value A.

(16) A liquid discharge apparatus comprising: a tank configured to receive liquid injected from an outside, the tank comprising a liquid chamber configured to retain the injected liquid; a remaining amount sensor; a head communicating with the liquid chamber of the tank; a notification device; and a controller configured to: control the head to discharge the liquid in accordance with a discharge instruction to discharge the liquid; update a first count value to a value corresponding to an amount of liquid instructed to be discharged by the discharge instruction after the liquid is injected into the liquid chamber of the tank, the first count value being updated in a direction of approximating to a threshold value A; obtain a first signal from the remaining amount sensor, the first signal being output by the remaining amount sensor in a case where a liquid level in the liquid chamber of the tank is a detection position or higher; obtain a second signal from the remaining amount sensor after the receiving of the first signal, the second signal being output by the remaining amount sensor in a case where the liquid level in the liquid chamber of the tank is lower than the detection position; and in a case where the first count value upon the receiving of the second signal reaches a threshold value β, control the notification device to perform notification in response to an updated first count value updated after the receiving of the second signal reaching the threshold value A, wherein the threshold value A is more distant from an initial value of the first count value than the threshold value β.

According to the disclosure, for the cartridge of which the first count value upon the receiving of the second signal from the remaining amount sensor reaches the threshold value α, the operating timing of the notification device is determined using the first count value. Therefore, it is possible to operate the notification device at appropriate timing without being influenced by the detection error of the remaining amount sensor.

What is claimed is:

1. A liquid discharge apparatus comprising:

a cartridge holder configured to receive a cartridge, the cartridge comprising a liquid chamber retaining liquid;

a remaining amount sensor;

a head configured to communicate with the liquid chamber of the cartridge mounted to the cartridge holder;

a notification device; and a controller configured to:

control the head to discharge the liquid in accordance with a discharge instruction to discharge the liquid;

update a first count value to a value corresponding to an amount of liquid instructed to be discharged by the discharge instruction after the cartridge is mounted to the cartridge holder, the first count value being updated in a direction of approximating to a threshold value A;

receive a first signal from the remaining amount sensor, the first signal being output by the remaining amount sensor in a case where a liquid level in the liquid chamber of the cartridge mounted to the cartridge holder is a detection position or higher;

receive a second signal from the remaining amount sensor after the receiving of the first signal, the second signal being output by the remaining amount sensor in a case where the liquid level in the liquid chamber of the cartridge mounted to the cartridge holder is lower than the detection position; and in a case where the first count value upon the receiving of the second signal reaches a threshold value α, control the notification device to perform notification in response to an updated first count value updated after the receiving of the second signal reaching the threshold value A, and wherein the threshold value A is more distant from an initial value of the first count value than the threshold value α, wherein in a case where the first count value upon the receiving of the second signal reaches the threshold value a and does not reach a threshold value β, the controller is configured to control the notification device to perform the notification in response to the updated first count value reaching the threshold value A, and wherein the threshold value β is more distant from the initial value of the first count value than the threshold value α.

2. The liquid discharge apparatus according to claim 1, wherein in a case where the first count value upon the receiving of the second signal does not reach the threshold value α or the first count value upon the receiving of the second signal reaches the threshold value β, the controller is configured to:

update a second count value to a value corresponding to an amount of liquid instructed to be discharged by the discharge instruction after the second signal is received, the second count value being updated in a direction of approximating to a threshold value X; and control the notification device to perform the notification in response to the updated second count value reaching the threshold value X.

3. The liquid discharge apparatus according to claim 2, further comprising a memory storing therein any one of a first value and a second value, wherein the controller is configured to:

store the first value in the memory in a case where the first count value upon the receiving of the second signal reaches the threshold value α and does not reach the threshold value β;

store the second value in the memory in a case where the first count value upon the receiving of the second signal does not reach the threshold value α or the first count value upon the receiving of the second signal reaches the threshold value β;

in a case where the memory stores the first value, control the notification device to perform the notification in response to the updated first count value reaching the threshold value A; and in a case where the memory stores the second value, control the notification device to perform the notification in response to the updated second count value reaching the threshold value X.

4. The liquid discharge apparatus according to claim 2, wherein a difference between an initial value of the second count value and the threshold value X is smaller than a difference between the first count value upon the receiving of the second signal and the threshold value A.

5. The liquid discharge apparatus according to claim 2, wherein the controller is further configured to prohibit discharge of the liquid from the head in response to the updated second count value reaching a threshold value Y, and wherein the threshold value Y is more distant from an initial value of the second count value than the threshold value X.

6. The liquid discharge apparatus according to claim 1, wherein a range indicated by the threshold value α and a range indicated by the threshold value β are received by adding and subtracting a detection error of the remaining amount sensor to and from a preset value, the preset value being corresponding to an amount of liquid that is to be retained in the liquid chamber of the cartridge upon the receiving of the second signal.

7. The liquid discharge apparatus according to claim 1, wherein the cartridge further comprises a detection object, the detection object being locatable at a first position in response to the liquid level in the liquid chamber of the cartridge mounted to the cartridge holder being the detection position or higher, the detection object being locatable at a second position in response to the liquid level being lower than the detection position, the second position being different from the first position, and wherein the remaining amount sensor is configured to:

output the first signal in a case where the detection object is located at the first position; and output the second signal in a case where the detection object is located at the second position.

8. A liquid discharge apparatus comprising:

a cartridge holder configured to receive a cartridge, the cartridge comprising a liquid chamber retaining liquid;

a remaining amount sensor;

a head configured to communicate with the liquid chamber of the cartridge mounted to the cartridge holder;

a notification device; and a controller configured to:

control the head to discharge the liquid in accordance with a discharge instruction to discharge the liquid;

update a first count value to a value corresponding to an amount of liquid instructed to be discharged by the discharge instruction after the cartridge is mounted to the cartridge holder, the first count value being updated in a direction of approximating to a threshold value A;

receive a first signal from the remaining amount sensor, the first signal being output by the remaining amount sensor in a case where a liquid level in the liquid chamber of the cartridge mounted to the cartridge holder is a detection position or higher;

receive a second signal from the remaining amount sensor after the receiving of the first signal, the second signal being output by the remaining amount sensor in a case where the liquid level in the liquid chamber of the cartridge mounted to the cartridge holder is lower than the detection position; and in a case where the first count value upon the receiving of the second signal reaches a threshold value α, control the notification device to perform notification in response to an updated first count value updated after the receiving of the second signal reaching the threshold value A, and wherein the threshold value A is more distant from an initial value of the first count value than the threshold value α wherein the controller is further configured to prohibit discharge of the liquid from the head in response to the updated first count value reaching a threshold value B, and wherein the threshold value B is more distant from the initial value of the first count value than the threshold value A.

9. The liquid discharge apparatus according to claim 8, wherein the controller is further configured to:

in a case where the first count value upon the receiving of the second signal reaches the threshold value α, update a second count value to a value corresponding to an amount of liquid instructed to be discharged by the discharge instruction after the second signal is received, the second count value being updated in a direction of approximating to a threshold value X; and control the notification device to perform the notification and prohibit discharge of the liquid from the head in response to the updated second count value reaching a threshold value C, and wherein a difference between an initial value of the second count value and the threshold value C is smaller than a difference between the first count value upon the receiving of the second signal and the threshold value A.

10. A liquid discharge apparatus comprising:

a cartridge holder configured to receive a cartridge, the cartridge comprising a liquid chamber retaining liquid;

a remaining amount sensor;

a head configured to communicate with the liquid chamber of the cartridge mounted to the cartridge holder;

a notification device; and a controller configured to:

control the head to discharge the liquid in accordance with a discharge instruction to discharge the liquid;

update a first count value to a value corresponding to an amount of liquid instructed to be discharged by the discharge instruction after the cartridge is mounted to the cartridge holder, the first count value being updated in a direction of approximating to a threshold value A;

receive a first signal from the remaining amount sensor, the first signal being output by the remaining amount sensor in a case where a liquid level in the liquid chamber of the cartridge mounted to the cartridge holder is a detection position or higher;

receive a second signal from the remaining amount sensor after the receiving of the first signal, the second signal being output by the remaining amount sensor in a case where the liquid level in the liquid chamber of the cartridge mounted to the cartridge holder is lower than the detection position; and in a case where the first count value upon the receiving of the second signal reaches a threshold value β, control the notification device to perform notification in response to an updated first count value updated after the receiving of the second signal reaching the threshold value A, wherein the threshold value A is more distant from an initial value of the first count value than the threshold value β, wherein the controller is further configured to prohibit discharge of the liquid from the head in response to the updated first count value reaching a threshold value B, and wherein the threshold value B is more distant from the initial value of the first count value than the threshold value A.

11. A liquid discharge apparatus comprising:

a tank configured to receive liquid injected from an outside, the tank comprising a liquid chamber configured to retain the injected liquid;

a remaining amount sensor;

a head communicating with the liquid chamber of the tank;

a notification device; and a controller configured to:

control the head to discharge the liquid in accordance with a discharge instruction to discharge the liquid;

update a first count value to a value corresponding to an amount of liquid instructed to be discharged by the discharge instruction after the liquid is injected into the liquid chamber of the tank, the first count value being updated in a direction of approximating to a threshold value A;

receive a first signal from the remaining amount sensor, the first signal being output by the remaining amount sensor in a case where a liquid level in the liquid chamber of the tank is a detection position or higher;

receive a second signal from the remaining amount sensor after the receiving of the first signal, the second signal being output by the remaining amount sensor in a case where the liquid level in the liquid chamber of the tank is lower than the detection position; and in a case where the first count value upon the receiving of the second signal reaches a threshold value α, control the notification device to perform notification in response to an updated first count value updated after the receiving of the second signal reaching the threshold value A, wherein the threshold value A is more distant from an initial value of the first count value than the threshold value α, wherein in a case where the first count value upon the receiving of the second signal reaches the threshold value α and does not reach a threshold value β, the controller is configured to control the notification device to perform the notification in response to the updated first count value reaching the threshold value A, and wherein the threshold value β is more distant from the initial value of the first count value than the threshold value α.

12. The liquid discharge apparatus according to claim 11, wherein in a case where the first count value upon the receiving of the second signal does not reach the threshold value α or the first count value upon the receiving of the second signal reaches the threshold value β, the controller is configured to:

update a second count value to a value corresponding to an amount of liquid instructed to be discharged by the discharge instruction after the second signal is received, the second count value being updated in a direction of approximating to a threshold value X; and control the notification device to perform the notification in response to the updated second count value reaching the threshold value X.

13. The liquid discharge apparatus according to claim 12, wherein a difference between an initial value of the second count value and the threshold value X is smaller than a difference between the first count value upon the receiving of the second signal and the threshold value A.

* * * * *